US009890797B2

(12) United States Patent
Wilfley

(10) Patent No.: US 9,890,797 B2
(45) Date of Patent: Feb. 13, 2018

(54) IMPELLER WITH REMOVABLE AND REPLACEABLE VANES FOR CENTRIFUGAL PUMP

(71) Applicant: AR IMPELLER, INC., Commerce City, CO (US)

(72) Inventor: Jack Frederick Wilfley, Golden, CO (US)

(73) Assignee: AR IMPELLER, INC., Commerce City, CO (US)

( * ) Notice: Subject to any disclaimer, the term of this patent is extended or adjusted under 35 U.S.C. 154(b) by 0 days.

(21) Appl. No.: 15/190,070

(22) Filed: Jun. 22, 2016

(65) Prior Publication Data

US 2017/0370379 A1 Dec. 28, 2017

(51) Int. Cl.

| | |
|---|---|
| ***F04D 29/30*** | (2006.01) |
| ***F04D 29/62*** | (2006.01) |
| ***F04D 29/26*** | (2006.01) |
| ***F04D 29/42*** | (2006.01) |

(52) U.S. Cl.

CPC ..... *F04D 29/622* (2013.01); *F04D 29/266* (2013.01); *F04D 29/30* (2013.01); *F04D 29/4206* (2013.01); *F04D 29/624* (2013.01)

(58) Field of Classification Search

CPC ..... F04D 15/0027; F04D 15/0055; F04D 27/002; Y10T 29/49316

USPC ..... 415/912

See application file for complete search history.

(56) References Cited

U.S. PATENT DOCUMENTS 2,976,811 A 3/1961 Sully
3,211,103 A 10/1965 Kiekhaefer
3,224,078 A * 12/1965 Mayne ..... B21D 53/267 29/889.4
4,139,330 A * 2/1979 Neal ..... F04D 29/2233 416/143
4,386,886 A * 6/1983 Neal ..... F04D 29/2244 415/131

(Continued)

FOREIGN PATENT DOCUMENTS

| | | |
|---|---|---|
| EP | 0770464 | 5/1997 |
| JP | 2014-238083 | 12/2014 |

OTHER PUBLICATIONS

Riegger et al., "Modern Manufacturing of Advanced Impeller and Diffuser Vane Profiles," Proceedings of the Twelfth International Pump Users Symposium, 2007, pp. 37-46.

(Continued)

*Primary Examiner* — Nathaniel Wiehe
*Assistant Examiner* — Jason Davis
(74) *Attorney, Agent, or Firm* — Sheridan Ross P.C.

(57) ABSTRACT

The present disclosure relates to impellers with removable and replaceable vanes, and methods of constructing such impellers. According to aspects of the present disclosure, a plurality of impeller back plates are provided with differently configured slots to receive removable vanes. In addition, a plurality of differently configured vanes are disclosed which may be connected to the plurality of impeller back plates. As a result, the desired performance characteristics of a pump based upon end use applications may be efficiently and quickly achieved by combining appropriately configured vanes and back plate into a desired impeller providing the desired characteristics, together with a particular pump casing and motor.

38 Claims, 23 Drawing Sheets

(56) References Cited

U.S. PATENT DOCUMENTS

| | | | | |
|---|---|---|---|---|
| 4,664,592 | A * | 5/1987 | Grzina | F04D 29/2266 415/171.1 |
| 5,181,844 | A | 1/1993 | Bishop et al. | |
| 5,921,754 | A | 7/1999 | Freitas et al. | |
| 6,156,090 | A * | 12/2000 | Ishikawa | F04D 29/30 416/144 |
| 6,609,890 | B2 * | 8/2003 | Budris | F04D 29/2222 416/1 |
| 6,685,424 | B1 * | 2/2004 | Ingalls | F04D 29/2222 415/1 |
| 6,820,334 | B2 * | 11/2004 | Kebbede | B23P 6/005 29/889.1 |
| 7,070,389 | B2 * | 7/2006 | Kim | F04D 29/023 416/185 |
| 7,762,778 | B2 * | 7/2010 | Purvines | B23P 15/006 416/186 A |
| 2002/0141894 | A1 | 10/2002 | Kirtley et al. | |
| 2011/0158795 | A1 * | 6/2011 | Burgess | F04D 29/167 415/191 |

OTHER PUBLICATIONS

Chaurette, "What is Head?," retrieved from http://www.pumpfundamentals.com/what%20is%20head.pdf, 2009, pp. 1-8.

* cited by examiner

FIG. 6D
FIG. 6A
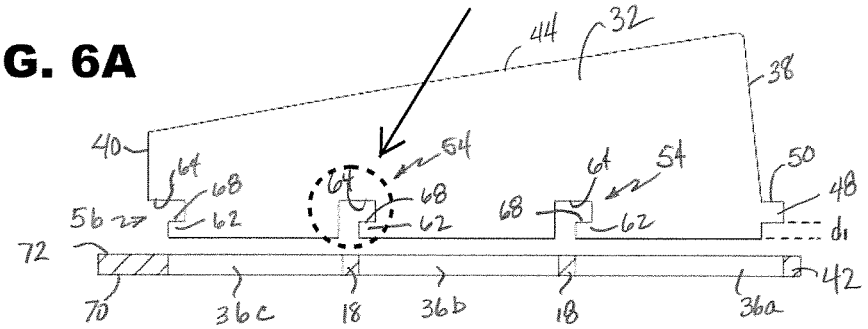
FIG. 6B
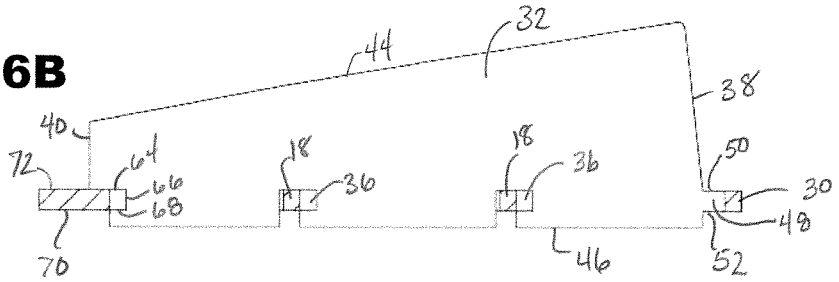
FIG. 6C
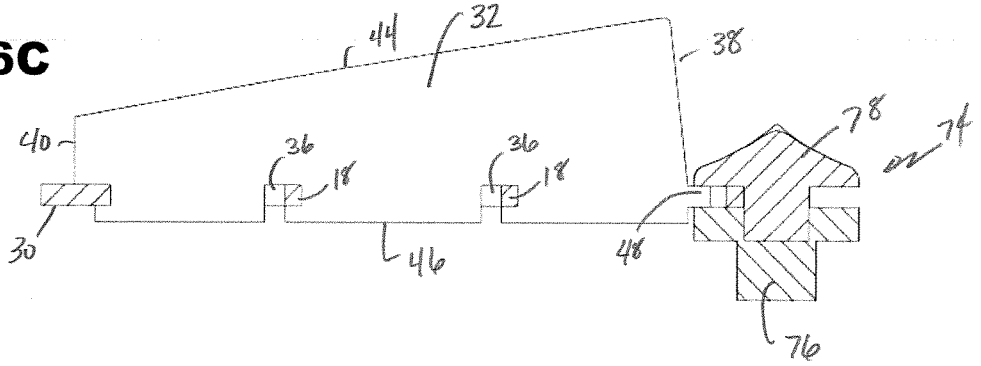

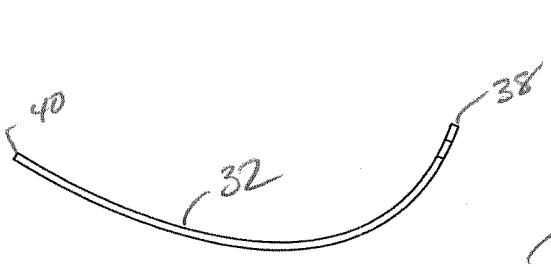
FIG. 13A
FIG. 13C
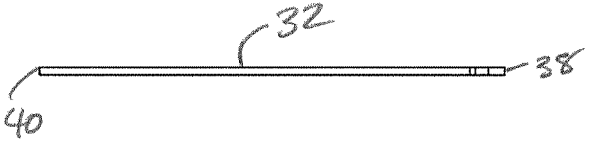
FIG. 13E
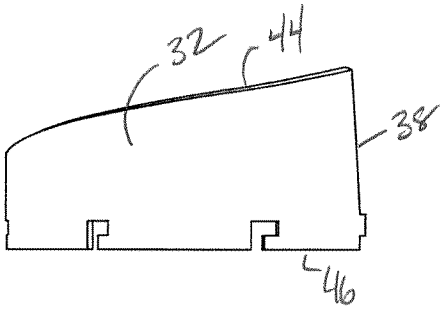
FIG. 13B
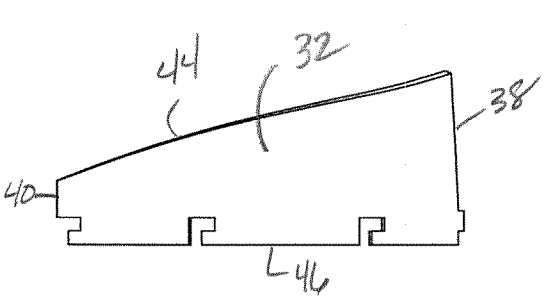
FIG. 13D
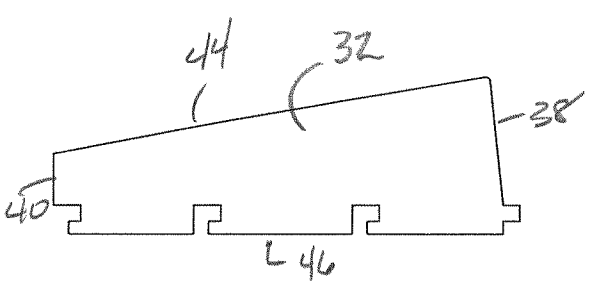
FIG. 13F

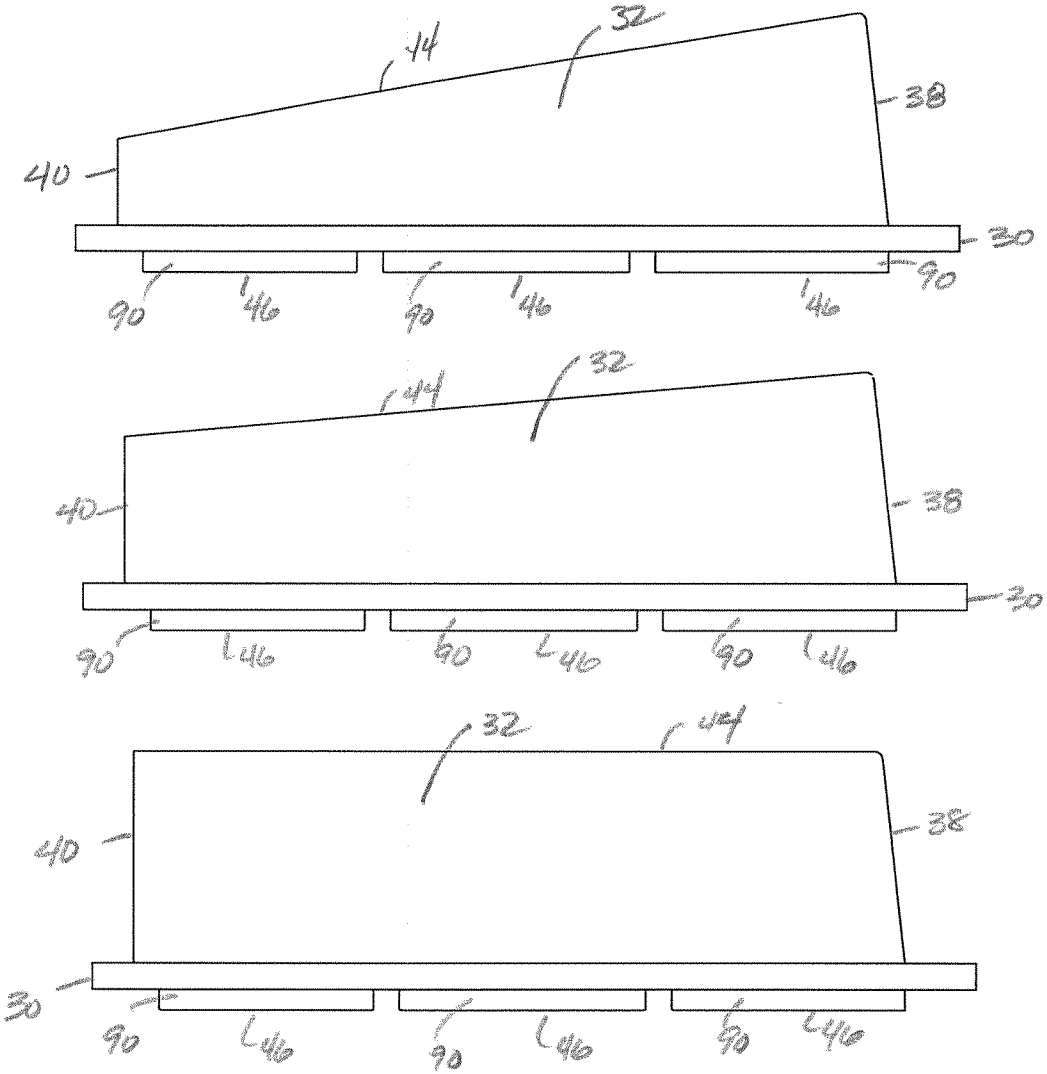
38
32
44
40
30
90
46
90
46
90
46

IMPELLER WITH REMOVABLE AND REPLACEABLE VANES FOR CENTRIFUGAL PUMP

FIELD OF THE INVENTION

Embodiments of the present invention relate to impellers having removable and replaceable vanes. While such impellers are primarily intended for use with kinetic pumps, the impellers may also be used with other varieties of pumps as well as other applications as will be apparent to a person of ordinary skill in the art upon reading this disclosure.

BACKGROUND OF THE INVENTION

Centrifugal pumps are perhaps the most common type of pump in operation today. With many different configurations available, centrifugal pumps are widely-used because of their design simplicity, high efficiency, wide range of capacity and head, smooth flow rate and ease of operation and maintenance. Centrifugal pumps use one or more impellers, which attach to and rotate with the pump shaft. This provides the energy that moves fluid through the pump and pressurizes the fluid to move it through a piping system. The pump therefore converts mechanical energy from a motor to energy of a moving fluid. A portion of the energy goes into kinetic energy of the fluid motion, and some goes into potential energy, represented by fluid pressure or by lifting the fluid, against gravity, to a higher altitude. As used herein, the term fluid is intended to encompass liquids and gases of varying densities, as well as liquids and gases containing solids. The matter flowing through a pump is also called the pumpage.

A centrifugal pump works by directing fluid in the system into the suction port of the pump and from there into the inlet of the impeller. The rotating impeller then moves the fluid along the spinning vanes, at the same time increasing the velocity energy of the fluid. The fluid then exits the impeller vanes and moves into the pump volute or diffuser casing, where the velocity of the fluid is converted into pressure through a diffusion process. The fluid is then guided into the discharge port of the pump and from there out into the system, or on to the next stage in the case of a multi-stage pump.

Centrifugal pumps are used in a variety of circumstances and conditions. They are often used for lower viscosity fluids and high flow rates. However, they may also be used with moderate and higher viscosity fluids or pumpage containing solids. They are typically used across many residential, commercial, industrial, and municipal applications. For example: commercial and residential building services, including pressure boosting, heating systems, fire protection sprinkler systems, drainage, and air conditioning; industry and water engineering, including boiler feed applications, water supply (municipal, industrial), wastewater management, irrigation, sprinkling, drainage and flood protection; chemical and process industries, including chemicals, hydrocarbons, pharmaceuticals, cellulose, petro-chemicals, sugar refining, food and beverage production; and secondary systems, including coolant recirculation, condensate transport, cryogenics, and refrigerants—to name a few.

It should be appreciated that no single centrifugal pump will meet all needs. It should also be appreciated that under current state of the art practices, it is impractical for pump manufacturers to design and build a custom pump for each customer's particular end use application. Rather, most pump manufacturers will offer a finite line of pumps offering varying performance characteristics. The line of pumps typically comprises a number of differently sized pump casings, a number of differently sized pump motors, and typically a single impeller design that can be used with each pump casing. The impeller may be modified, such as by trimming its vanes, to shift the performance characteristics of an individual pump. In addition, there is a practical limit to the number of different pump casings, pump motors and impellers a manufacturer will stock. Accordingly, situations arise where a specific pump manufacturer does not stock a pump that meets the needs of a specific customer's end use application. For example, available impeller, motor and pump casings may not achieve the desired flow rate and/or head requirements, or these requirements may be achieved but at a low or unacceptable efficiency. As a result, the manufacturer will attempt to trim an existing impeller to meet the customer's performance needs. If the manufacturer is unable to modify the impeller in a way that achieves the customer's requirements, the customer may ultimately purchase the pump from another manufacturer and the first contacted manufacturer loses a sale.

Many factors are important when designing or selecting a pump. Among these factors are efficiency, flow rate and head. The importance of pump efficiency is directly related to the use of energy and, therefore, cost to operate. Friction produced by bearings and other mechanical components, such as seals, stuffing box, etc., adversely affect pump efficiency, but the impeller and volute have the greatest influence on efficiency. For any given impeller, it is known that the head it produces varies as the square of a change in speed. Generally speaking, head is the height at which a pump can raise a fluid. Double the speed and the head increases by a factor of four. If the speed is held constant, the same rule holds true for a change in its diameter. In other words, double the diameter of the impeller and the head increases by a factor of four. The fluid flow through an impeller follows a similar rule but its change is directly proportional to the impeller speed or diameter. Accordingly, doubling the speed or diameter of the impeller doubles the fluid flow. A change in rotational speed of an impeller is in reference to the peripheral speed of a point on its outer most circumference. It is this speed that determines the absolute maximum head and flow attainable by any impeller.

The head produced by an impeller is almost entirely dependent upon its peripheral velocity but, flow is influenced by several other factors. The width and depth of the vanes and the diameter of the impeller center opening or eye are important considerations as they determine the ease with which some volume of water can pass through the impeller. Other factors such as vane shape also influence an impeller's performance.

The shape and spacing of the impeller vanes also have a large effect upon efficiency. Ideally, a pump would have as many vanes as possible that fit within the casing, but the physical constraints of the casing typically limits the number of vanes to between 5 and 7 and even fewer for pumps that handle larger solids.

Deeper vanes will produce high flow. Conversely, shallower vanes and deep expeller vanes will increase head. Any pumping application is balancing between obtaining the flow required at the correct head. Adding depth to the pumping vane will increase overall flow, but possibly drop the pressure capability. Adding depth to the expeller vane will increase the overall pressure capability but possibly drop flow capacity. Deeper expeller vanes can also increase head by a reduction of pressure applied to the seal. Putting aside designing and manufacturing a custom impeller for each end user's specific needs which would be costly and take too long to produce, current pump manufacturers have, at best, a limited ability to vary the relative depth of pumping vanes and expeller vanes, and almost no ability to vary vane curvature, vane configuration or orientation, or vane count. To the contrary, present manufacturers typically are limited to a finite and small number of fixed impeller designs for each pump casing sell. As used herein, the terms vane or impeller vane refers to the vanes on the same side of the back plate as the intake port, and the term expeller vane refers to the vanes on the side of the back plate opposite the intake port.

SUMMARY

The apparatus and methods explained in the present disclosure have advantages over current practices. In contrast to current practices, the performance of an individual centrifugal pump may be altered and enhanced in ways heretofore unavailable. The performance benefit may address a single parameter, such as head, flow rate, power consumption, efficiency, pressures applied to the seal or sealing mechanisms, radial forces applied to the shaft to then redirect runout tolerance on the seal mechanism, or a combination of such parameters for a given fluid pumping application. Alternatively, the benefit may address repurposing of a specific pump for a different fluid or end use application compared to the original design and use of the pump.

As one example, an impeller for use with a centrifugal pump is provided with one or more removable vanes. The pump casing has an internal chamber of fixed dimension. One end of a shaft extends into the chamber and the opposite end of the shaft is connected to a motor for purposes of rotating the shaft. The impeller is mounted to the end of the shaft inside the chamber. According to aspects of the present disclosure, the impeller comprises a back plate having at least one radially extending slot extending through the thickness of the back plate in the axial direction, where the axial direction is defined by the orientation of the shaft. The radial direction is defined as a direction away from the shaft. More commonly, a plurality of such slots are formed in the back plate. Each slot has a first end located proximate an inner radial position of the back plate and a second end located at an outer radial position proximate the perimeter edge of the back plate. Alternatively, each radially extending slot may comprise a plurality of slot segments intermittently discontinued or interrupted by a portion of the back plate. In addition, a removable vane is configured to seat within each radially extending slot or plurality of slot segments and connect to the back plate. The vane may be physically configured in a way to engage or interfit with the back plate for purposes of securing each vane to the back plate, an inner hub may be used to secure the vane relative to the back plate, as well as secure the back plate to the shaft, and other mechanical means may be used to secure the vane relative to the back plate, or a combination of one or more of these methods may be used to secure the vane relative to the back plate. Additionally, the centrifugal force generated by the rotating impeller may be used, in combination with the interconnecting structure of the vane and back plate, to assist in securing the vanes relative to the back plate. Regardless, each vane is removable and replaceable. As another aspect of the present disclosure, each vane may extend completely through the back plate to form both impeller and expeller vanes and the extent to which the vane extends through the back plate is variable. Alternatively, the slots may not extend completely though the back plate, but the vanes still configured to nest in a slot and be secured relative to the back plate. Being able to substitute vanes having different profiles or shapes, including modifying the vane impeller depth and/or expeller depth in a design, adds flexibility to meet end user requirements. There are many factors that go into optimizing an impeller design. As noted, one advantage of impellers consistent with the present disclosure is the flexibility to tailor the pumping vane depth, and corresponding expeller vane depth if appropriate, to meet hydraulic conditions. The ability to vary the depth of the impeller vanes as well as the expeller vanes provides manufacturers and end users the ability to match performance requirements for a particular application, including flow and head requirements, to given conditions. The ability to vary other aspects of the impeller as described herein provide even greater flexibility to achieve performance requirements.

According to another aspect of the present disclosure, a single back plate, with a non-variable set of slots may be used in combination with a variety of differently configured vanes to alter and enhance the performance parameters of an impeller and, more particularly, the pump in which the impeller is installed. For example, while using the same back plate a second set of vanes may be substituted for a first set of vanes to alter the performance of the pump. The second set of vanes may have a different height, profile, shape, thickness, surface characteristic and/or be made from different material. The material may be a metal, alloy or composite, where the composite is thermosetting or thermoplastic. The material may have different degrees of surface smoothness, from rough to smooth, including grooved or channeled. The individual vanes may be straight or curved, the extent of curvature may vary, and/or the vanes may have a complex three-dimensional curvature. Further still, a variety of differently shaped vanes may be used on a single impeller. The vanes may be firm or have varying degrees of pliability or flexibility. For example, if a specific stiffness is required, the vanes could be metal of an appropriate thickness to achieve the stiffness, or the vanes could be made of composite material with the composite fibers oriented axially. Such a vane would be stiff in the axial direction and pliable in the radial direction. Radial pliability allows the vanes to be bent into a desired curved shape. The shape of a vane may also vary in the axial direction. The vanes could also be custom designed and shaped to proximate the dimension of the pump chamber for enhanced performance characteristics appropriate to the application. Alternatively, the vanes could be designed to be slightly longer in the axial direction than fits within the chamber such that the inner surface of the chamber physically wears down the vane height to a near perfect fit.

According to another aspect of the invention, the back plate may also be subject to variation. Thus, the number of slots, the curvature of the slots and the orientation of the slots can change. For example, one back plate may have one slot to hold one vane, another may have three slots to hold three vanes, another may have five slots, or seven slots or more. Further still, the orientation of the slot relative to the back plate may change such that the vanes are generally perpendicular to the back plate or sloped relative to the back plate. In addition, the orientation of the slots may be configured to vary the curvature of the vanes. Further still, the back plate may be manufactured flat or may be manufactured to a given curvature. By using curvature in the back plate, greater stiffness can be achieved with reduced material usage, or greater overall stiffness and performance can be created with the same material. In general, utilizing a simple geometrical curvature can increase stiffness by as much as ten times more. Using back plate curvature as a stiffening technique can reduce material usage and cost, and/or help increase performance capabilities. Along the same lines, stiffening ribs may be added to one or both sides of the back plate to add rigidity and permit use of a thinner back plate. The ribs may be radially positioned, like spokes on a wheel, curved—parallel to the path of a vane, or have a more complex profile.

According to a further aspect of the present disclosure, multiple back plates may be used with a single set of vanes, while still achieving the variability noted above. For example, adding a second back plate may reconfigure an open impeller into a closed impeller and provide the performance characteristics associated with closed impeller configurations. Alternatively, two or more back plates may be used with the vanes extending through both of the back plates. The resulting configuration would be a hybrid impeller that has characteristics of both an open and closed design simultaneously. In addition, multiple back plates used simultaneously will provide added support to the vanes, permitting the vanes to be made thinner and/or perhaps less expensively, thereby providing cost savings, as well as achieving variability in performance.

As a further alternative, the back plate material may be plastic, depending upon the end use of the impeller. For example, if the fluid is air, a plastic impeller could be more suitable that a metal or composite impeller and cost significantly less.

Further aspects of the present disclosure allow for self-adjusting or floating vanes. For example, a set of vanes could be designed to purposefully wear against the inside surface of the chamber. When initially installed, the vanes would extend axially in both directions relative to the back plate. As the vanes wore against the inside surface of the chamber on the impeller side of the back plate, the vanes would slide axially or adjust relative to the expeller side of the back plate. Thus, the expeller portion of the vanes would gradually decrease while the impeller portion of the vanes would maintain generally the same height or axial length.

While one aspect of the present design is to reduce cost and production time by allowing manufacturers to maintain inventory of back plates and vanes of varying configurations, the concepts of the present disclosure also enhance custom design in a more cost effective fashion. For example, if a specific end use application requires a particular flow rate, peak efficiency and peak efficiency flow, once these parameters are determined, an impeller having such performance parameters may be readily constructed from existing inventory or by only manufacturing a set of vanes to combine with an existing back plate, thereby avoiding costly and time consuming casting or manufacturing processes associated with the back plate.

As another example, aspects of the present disclosure allow rapid transition of pump performance simply by replacing impeller vanes. In one example, an existing pump installed at a chemical processing facility and designed for use with caustic chemicals has a casing with a three inch intake and a two inch discharge. The original impeller provides a maximum flow rate of 220 gallons per minute, a peak efficiency of fifty-five percent and a peak efficiency flow of 170 gallons per minute. But business reasons compel the facility operator to change the performance characteristics to a maximum flow of 470 gallons per minute, a peak efficiency of seventy percent and a peak efficiency flow rate of 315 gallons per minute, while using a ten horsepower motor due to physical space constraints. Using the concepts of the present disclosure, the new performance parameters are achievable. A new impeller may be quickly and efficiently assembled and installed in an existing pump casing to change the performance parameters of the pump to meet the new requirements with minimum downtime and without the delay of designing and manufacturing a new custom impeller. As a second example, the concepts of the present disclosure permit a manufacturer to stock a plurality of differently configured back plates having a variety of differently oriented and configured slots, and also stock a plurality of differently configured removable vanes that are configured to fit within the slots and form an impeller when assembled. As a result, a manufacturer, upon learning of a customer's pumping conditions and requirements, may quickly assemble an impeller that meets the customer's needs. The manufacturer would select a specific back plate from the plurality of back plates in stock, and would select a set of vanes from the plurality of vanes in stock. The components would be assembled and the finished impeller mounted on a shaft and installed in a pump casing. The design and construction flexibility afforded by the aspects of the present disclosure provide manufacturers and end users a significant improvement over traditional pump design and construction methods.

As a result of the foregoing, the concepts of the present disclosure eliminate the impediment of trying to meet a customer's needs by trimming an existing impeller, and provide accelerated implementation of new performance capabilities, with an enhanced range of performance for existing pumps casings and motors. The concepts of the present disclosure also extend the life of existing pumps, resulting in cost savings to the pump operator. The concepts of the present disclosure also expand and enhance performance across a manufacturer's product line and across an end user's inventory. It should be further appreciated that all of the foregoing concepts may be implemented individually or in any combination as needed for any given conditions.

The concepts of the present disclosure have applicability to kinetic pumps and positive displacement pumps. Within kinetic pumps there are special effect, centrifugal, and regenerative turbine pumps. Within centrifugal pumps there overhung impellers, impellers between bearings, and turbine type pumps.

These and other advantages will be apparent from the disclosure of the invention(s) contained herein. The above-described embodiments, objectives, and configurations are neither complete nor exhaustive. As will be appreciated, other embodiments of the invention are possible using, alone or in combination, one or more of the features set forth above or described in detail below.

Further, the summary of the invention is neither intended nor should it be construed as being representative of the full extent and scope of the present invention. The present invention is set forth in various levels of detail in the summary of the invention, as well as, in the attached drawings and the detailed description and no limitation as to the scope of the present invention is intended to either the inclusion or non-inclusion of elements, components, etc. in this summary. Additional aspects of the present invention will become more readily apparent from the detailed description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

FIG. 6A is an exploded cross-sectional plan view of a portion of an impeller and removable vane according to aspects of the present disclosure.

FIG. 6B is a partially assembled view of the partial impeller of FIG. 6A.

FIG. 6C is a fully assembled view of the partial impeller of FIG. 6A.

FIG. 13A is a top plan view of a removable impeller vane according to aspects of the present disclosure.

FIG. 13B is an elevational plan view of the removable vane of FIG. 13A.

FIG. 13C is a top plan view of a removable impeller vane according to aspects of the present disclosure.

FIG. 13D is an elevational plan view of the removable vane of FIG. 13C.

FIG. 13E is a top plan view of a removable impeller vane according to aspects of the present disclosure.

FIG. 13F is an elevational plan view of the removable vane of FIG. 13E.

FIG. 14A is a plan view of an impeller back plate and vane according to aspects of the present disclosure.

FIG. 14B is a plan view of an impeller back plate and vane according to aspects of the present disclosure.

FIG. 14C is a plan view of an impeller back plate and vane according to aspects of the present disclosure.

While the following disclosure describes the invention in connection with those aspects presented, one should understand that the invention is not strictly limited to these aspects. Furthermore, one should understand that the drawings are not necessarily to scale, and that in certain instances, the disclosure may not include details which are not necessary for an understanding of the present invention, such as conventional details of fabrication and assembly.

DETAILED DESCRIPTION

Figure 1:
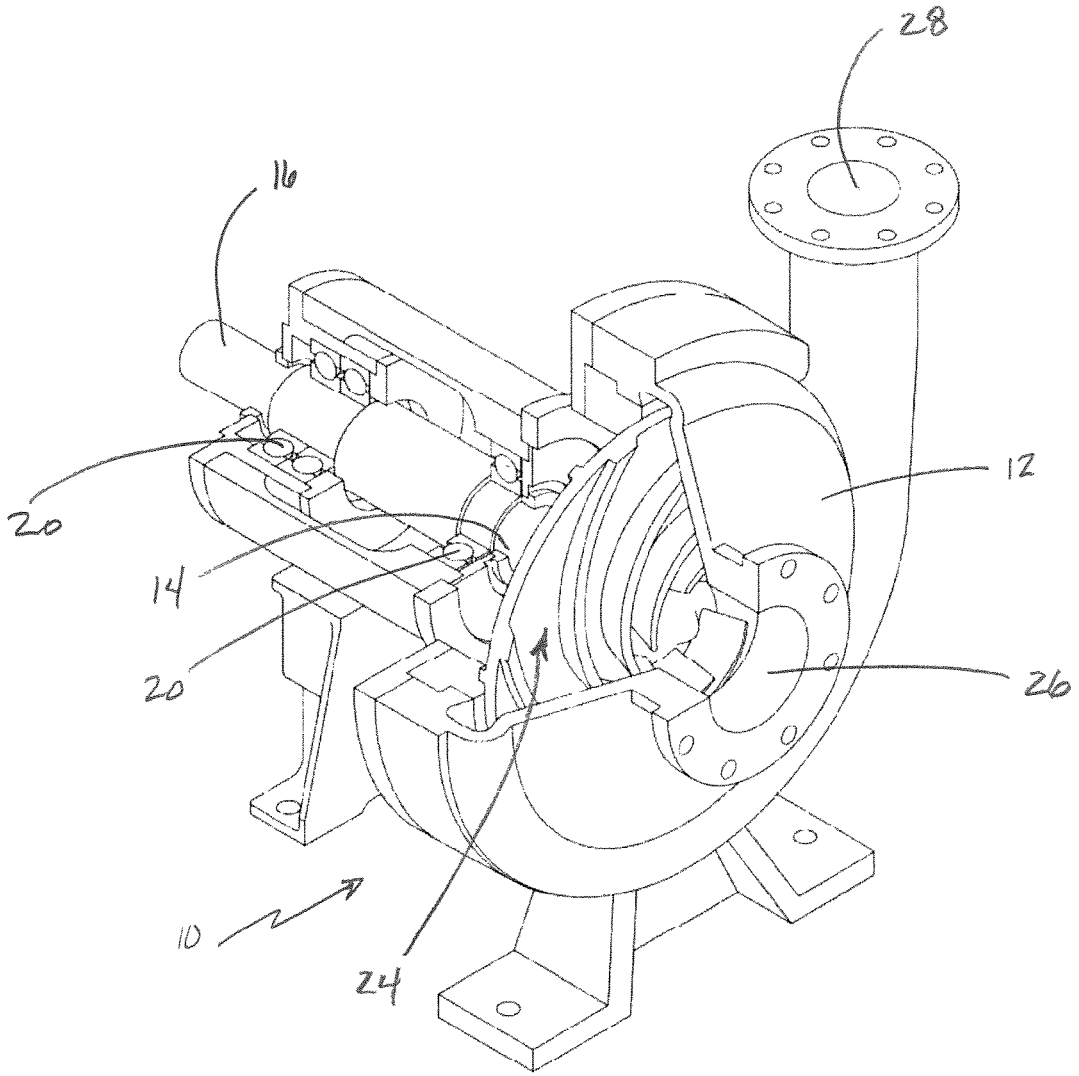
FIG. 1 is a perspective view of a centrifugal pump with a portion of the casing removed.

Turning to FIG. 1, one embodiment of a centrifugal pump 10 is illustrated with a portion of the casing 12 removed to reveal internal structures. The casing has a first opening 14 to receive a rotary shaft 16. The shaft is rotated by a motor (not shown) and supported by bearings 20. An impeller 22 is affixed to the end of the shaft 16 and is positioned in an interior chamber 24 of the casing 12. The casing further includes an intake opening 26 that is in fluid communication with the chamber 24 and a discharge port 28 which is also in fluid communication with the chamber 24. In operation, the motor rotates the shaft 16 and impeller 22. Rotation of the impeller 22 causes fluid to be drawn into the chamber 24 through the intake opening 26 and expelled out of the discharge port 28.

Figure 2A:
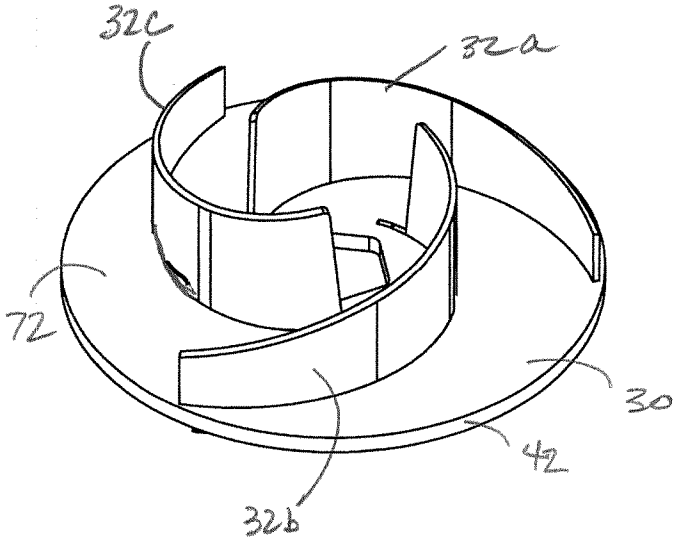
FIG. 2A is a perspective of an impeller with removable vanes according to one aspect of the present disclosure.
Figure 2B:
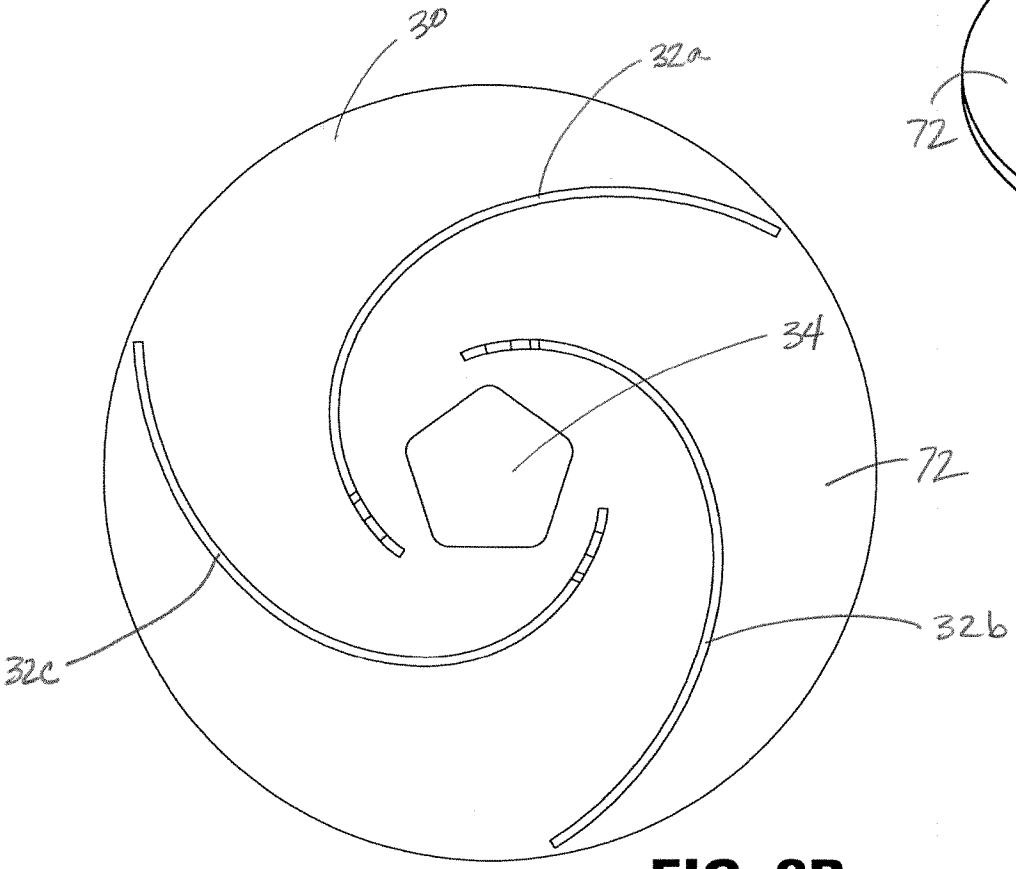
FIG. 2B is a top plan view of the impeller of FIG. 2A.

FIGS. 2A and 2B illustrate one embodiment of an impeller made according to aspects of the present disclosure. The impeller comprises a back plate 30 and three curved vanes 32*a*-32*c*. The vanes 32*a*-32*c* are removable from the back plate 30. A multi-sided aperture 34 is formed in the center of the plate 30 for connecting to the shaft 16. Here the aperture 34 has five sides. The vanes have a curved profile and a height that decreases as the vane moves from an inner radial location to an outer radial location on the back plate 30. As illustrated, the vanes are oriented generally perpendicular to the back plate 30.

Figure 3A:
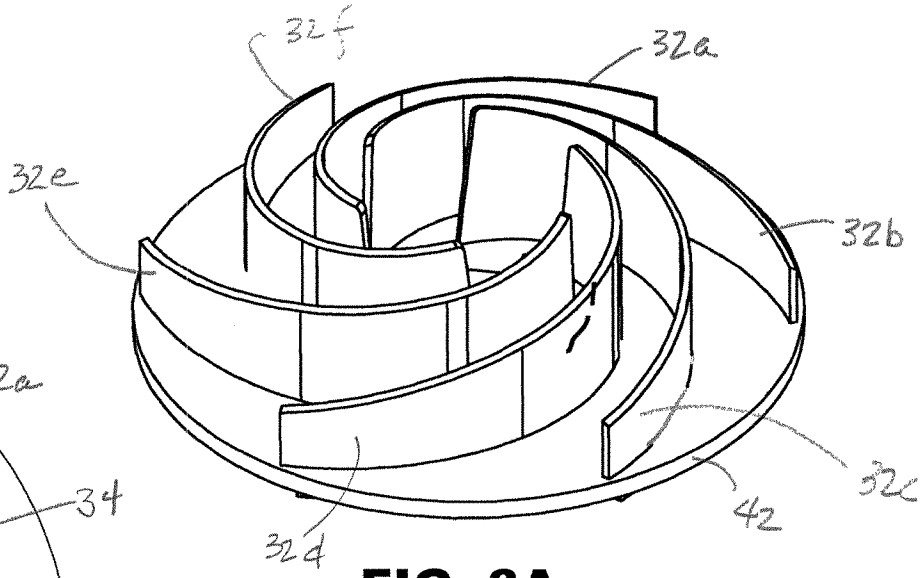
FIG. 3A is a perspective view of an impeller made according to one aspect of the present disclosure.
Figure 3B:
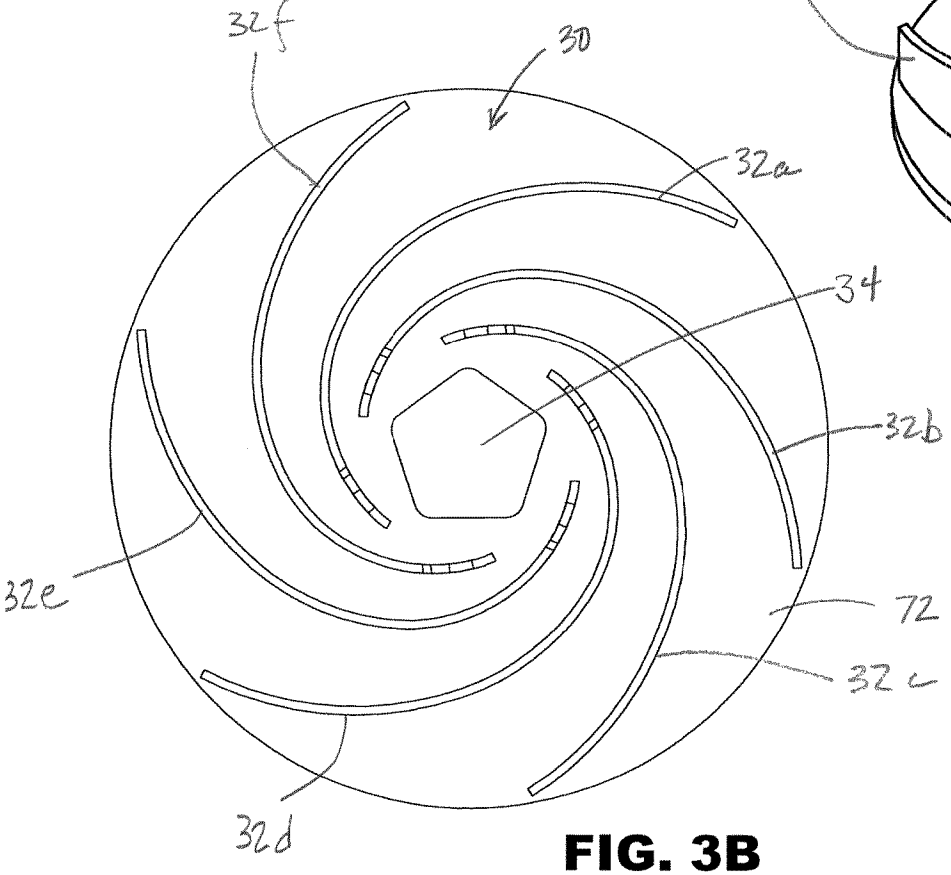
FIG. 3B is a top plan view of the impeller of FIG. 3A.

A second embodiment of an impeller made according to aspects of the present disclosure is shown in FIGS. 3A and 3B. Here, the impeller has six removable vanes 32*a*-32*f* The curvature of the vanes 32 may be the same as or different from the curvature of the vanes shown in FIGS. 2A and 2B. In addition, the varying height profile of the vanes 32*a*-32*f* may be the same as or different from that illustrated in FIGS. 2A and 2B.

Figure 4:
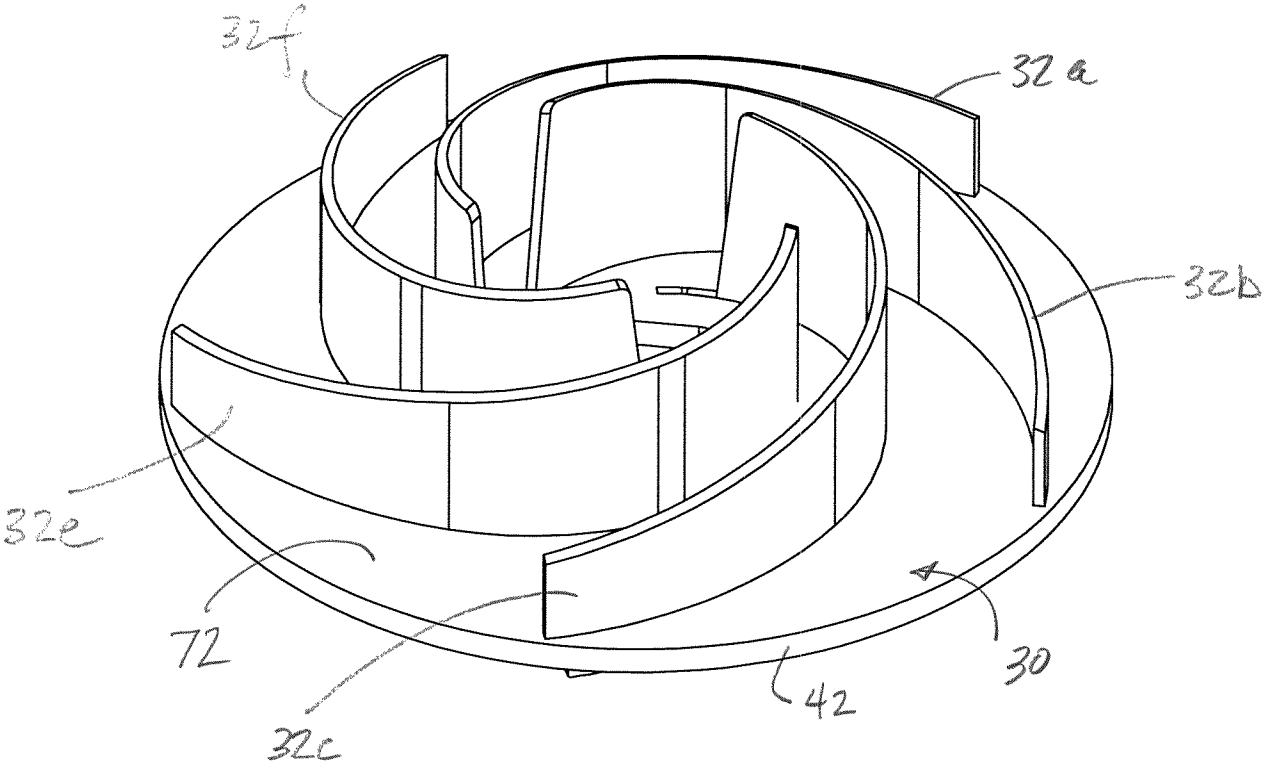
FIG. 4 is a perspective of an impeller made according to one aspect of the present disclosure.

FIG. 4 illustrates another impeller made according to aspects of the present disclosure. Here, five removable vanes 32*a*-32*e* are utilized.

Figure 5:
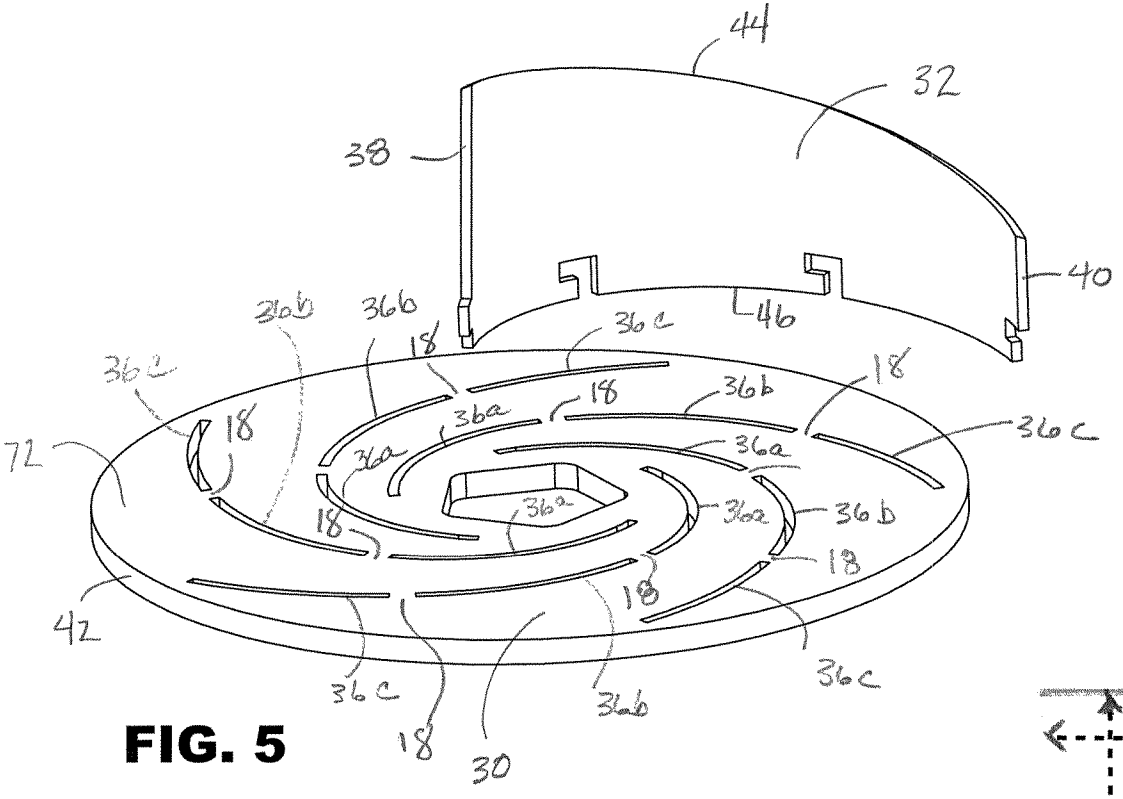
FIG. 5 is a partial exploded perspective view of the impeller of FIG. 4.
Figure 6D:
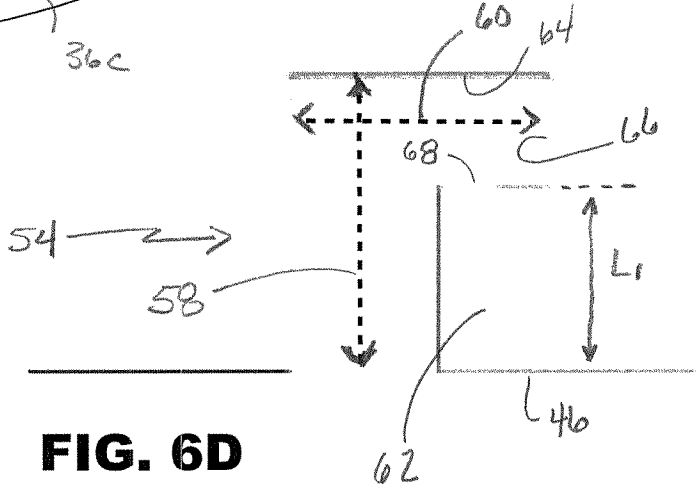
FIG. 6D is an enlarged plan view of an exemplary cutout as illustrated in FIG. 6A.

Turning to FIG. 5, a back plate 30 is shown having slots 36 formed through the entire thickness of the back plate 30. The slots are designed to receive and secure vanes 32. As illustrated in this embodiment, three slot segments 36*a*, 36*b* and 36*c*, form a discontinuous slot 36 interrupted by portions 18 of the back plate. The vane 32 may have a pre-set curvature that matches the orientation of the slot segments 36*a*, 36*b* and 36*c*, or the vane may be made from a flexible material that allows it to be bent or curved during installation to fit within the slots 36. An individual slot 36 may comprise one or more slot segments. The vane has a radial inner edge 38 and a radial outer edge 40. Here, the use of the term "radial" is in reference to a position relative to the back plate 30. Thus, a radial inner position is closer to the aperture 34 than a radial outer position. A radial outer position is closer to the perimeter edge 42 of the back plate 30. Each vane 32 also has an axial outer edge 44 and an axial inner edge 46. Here, the term "axial" is in reference to the orientation of the pump shaft 16. The axial outer edge 44 is typically located closer to the intake opening 26 and a further distance from the back plate 30 than the axial inner edge 46. The axial inner edge 46 of a vane 32 is located farther from the intake opening 26 and closer to the back plate 30.

With reference to FIGS. 5 and 6A, 6B and 6C, an explanation of how a vane 32 is interconnected to a back plate 30 according to one aspect of the invention will be described. A tab 48 extends from the radial inner edge 38 of the vane 32. The tab 48 is spaced axially outwardly from the axial inner edge 46 by a distance di that is the same or substantially the same as the thickness of the back plate 30. The tab 48 has an axially outer edge 50 and an axial inner edge 52. Two "L"-shaped cutouts 54 are formed along the axial inner edge 46 of the vane 32. A similarly shaped cutout 56 is formed at the intersection of the radial outer edge 40 and axial inner edge 46 of the vane 32. As shown in FIG. 6D, each of the cutouts form an axial channel 58, a radial channel 60 and a tab 62. Each of the tabs 62 have an axial length Li equal to or substantially the same as distance di. The radial channel 60 has a radial inner most surface 66.

As seen by the sequence provided by FIGS. 6A-6C, a vane 32 is aligned over the slot segments 36*a*, 36*b* and 36*c* in the back plate 30. FIG. 6A is a cross-section of the back plate 30 taken through and including slot segments 36*a*, 36*b* and 36*c*. Although the slot segments are depicted in FIG. 5 as being curved, it should be appreciated that slot segments 36*a*, 36*b* and 36*c* may be in the form of a differently shaped curved line or a straight line. The vane may be pre-curved to fit into the slot segments or may be bent in place to fit into the slot segments. The vane is inserted into and through the slots as shown in FIG. 6B, and then moved to the left as shown in FIG. 6C. As a result, the back plate is captured between the tabs 62 and the axial outer edge 64 of the L-shaped cutouts 54 and 56. The axial outer edge 68 of the tabs 62 engage the lower surface 70 of the back plate 30, and the axial outer edge 64 of the cutouts 54 and 56 engage the upper surface 72 of the back plate 30. As shown in FIG. 6C, the hub 74 has a first portion 76 that is secured to the shaft 16 and is configured to receive the second portion 78. When the first portion is joined to the second portion, the tab 48 and back plate 30 are captured between the first portion 76 and second portion 78 to secure radial inner edge 38 of the vane 32.

When the pump is operating and the impellers rotating about the shaft, a centrifugal force will also act on the vanes 32 and assist in securing each vane relative to the back plate. More specifically, with reference to FIG. 6C, the vane 32 will be forced to the left such that the back plate 30 will be secured between surfaces 64, 66 and 68 of the radial channel 60. For added securement, the back plate may include grooves (not shown) that capture and secure the edges of the vane proximate surfaces 64, 66 and 68.

Figure 8A:
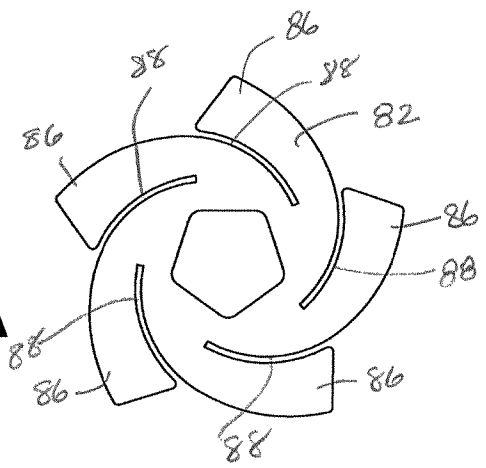
FIG. 8A is a top plan view of an optional secondary back plate according to aspects of the present disclosure.
Figure 8B:
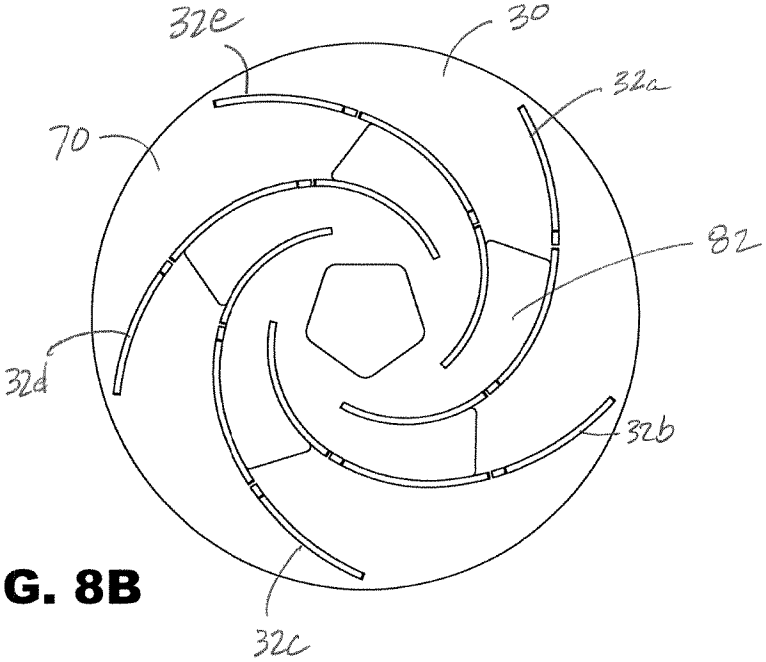
FIG. 8B is a top plan view of an impeller incorporating the optional back plate of FIG. 8A.
Figure 7A:
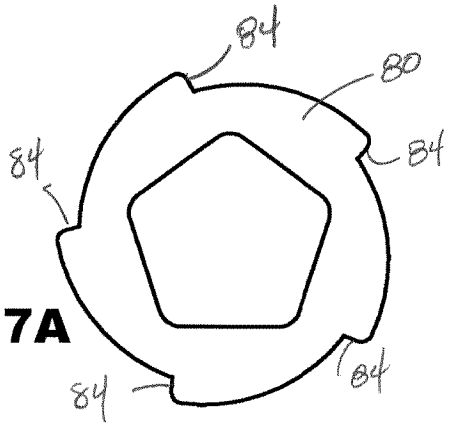
FIG. 7A is a top plan view of an optional secondary back plate according to one aspect of the present disclosure.
Figure 7B:
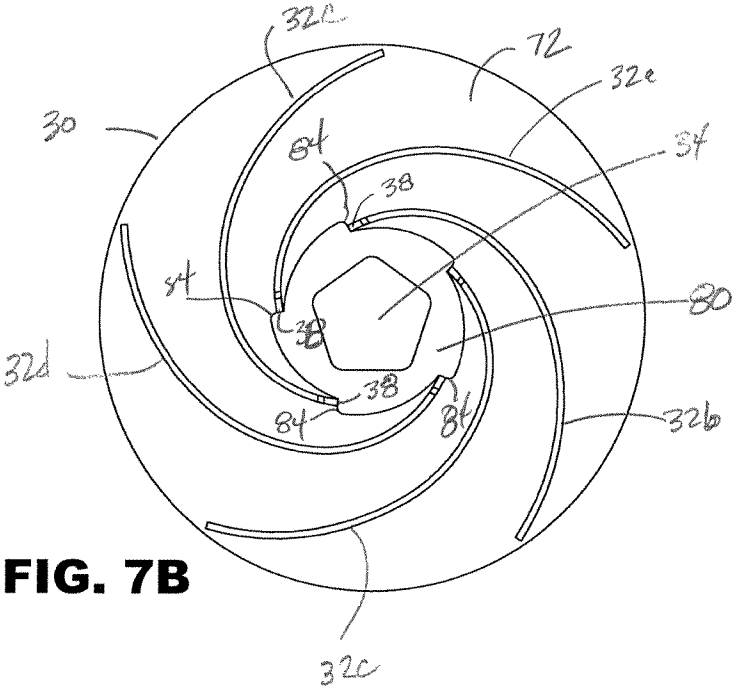
FIG. 7B is a top plan view of an impeller incorporating the optional back plate of FIG. 7A.

Also for enhanced securement, secondary or additional back plates 80 and 82 may optionally be included for securing the vanes 32 relative to the back plate 30. FIGS. 7A and 7B show optional additional back plate 80 which would be positioned on the axial outer surface 72 of the back plate 30, and FIGS. 8A and 8B show the optional additional back plate 82 which would engage the inner axial surface 70 of the back plate 30. Additional back plate 80 is formed with shoulders 84 to abut the radial inner edge 38 of each of the vanes 32, as well as overlap tab 48 of the vane 32. Secondary or additional back plate 82 includes outwardly extending radial arms 86 separated by channels 88. The axial inner edge 46 of the vanes fit in the channels 88, and the radial arms 86 lie in the space between adjacent vanes 32.

Figure 9:
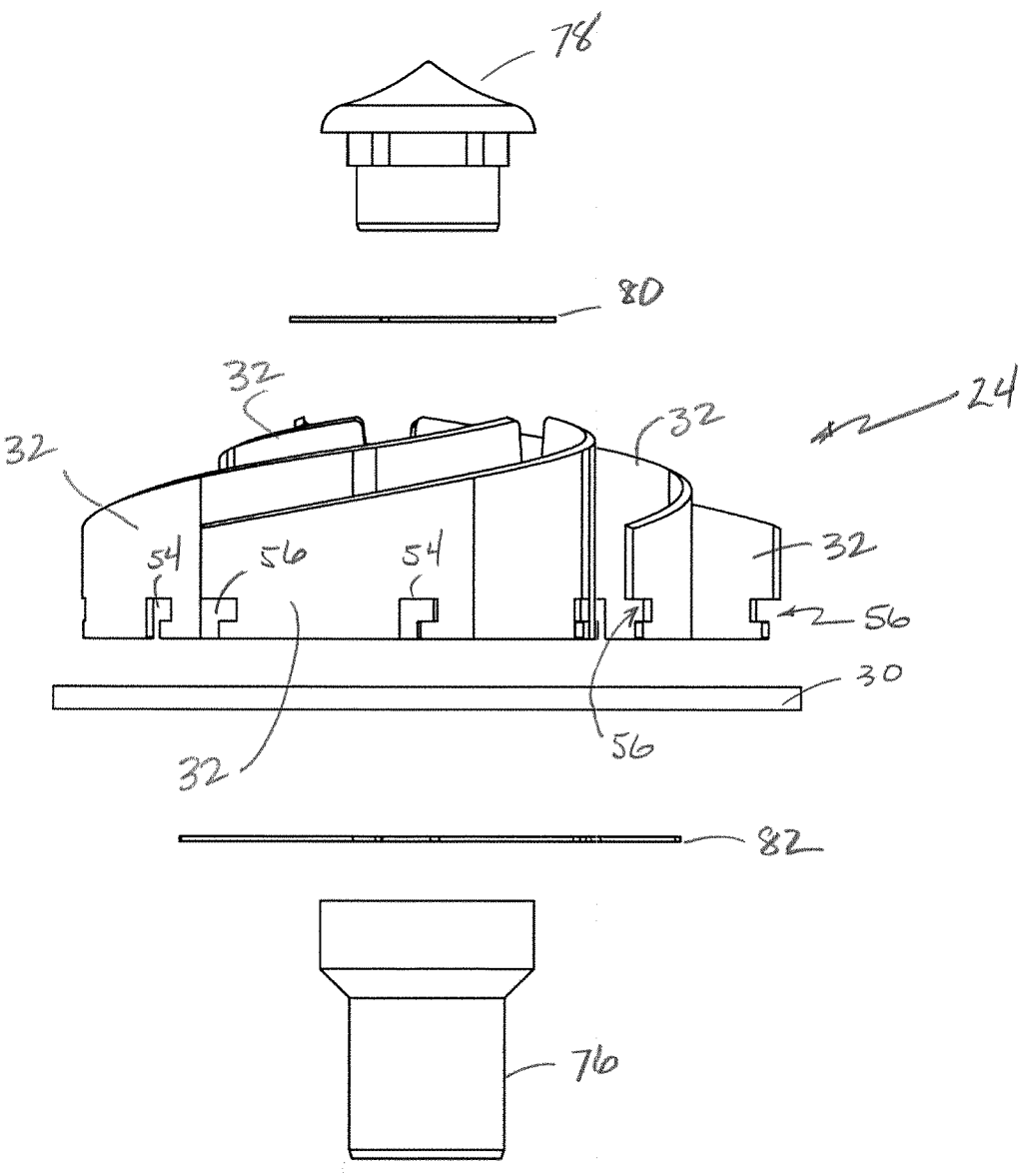
FIG. 9 is an exploded plan view of an impeller assembly incorporating two optional secondary back plates according to one aspect of the present disclosure.

An exploded view of an impeller assembly according to one aspect of the present disclosure is illustrated in FIG. 9. It should be appreciated that the additional back plate 80 could also be positioned on the opposite side of the back plate 30, and additionally back plate 82 could also be used on both sides of the back plate 30. Further still, the additional back plate 30 could be differently configured. For example, the arms 86 could have a different length or could vary in length on a single back plate.

Figure 10:
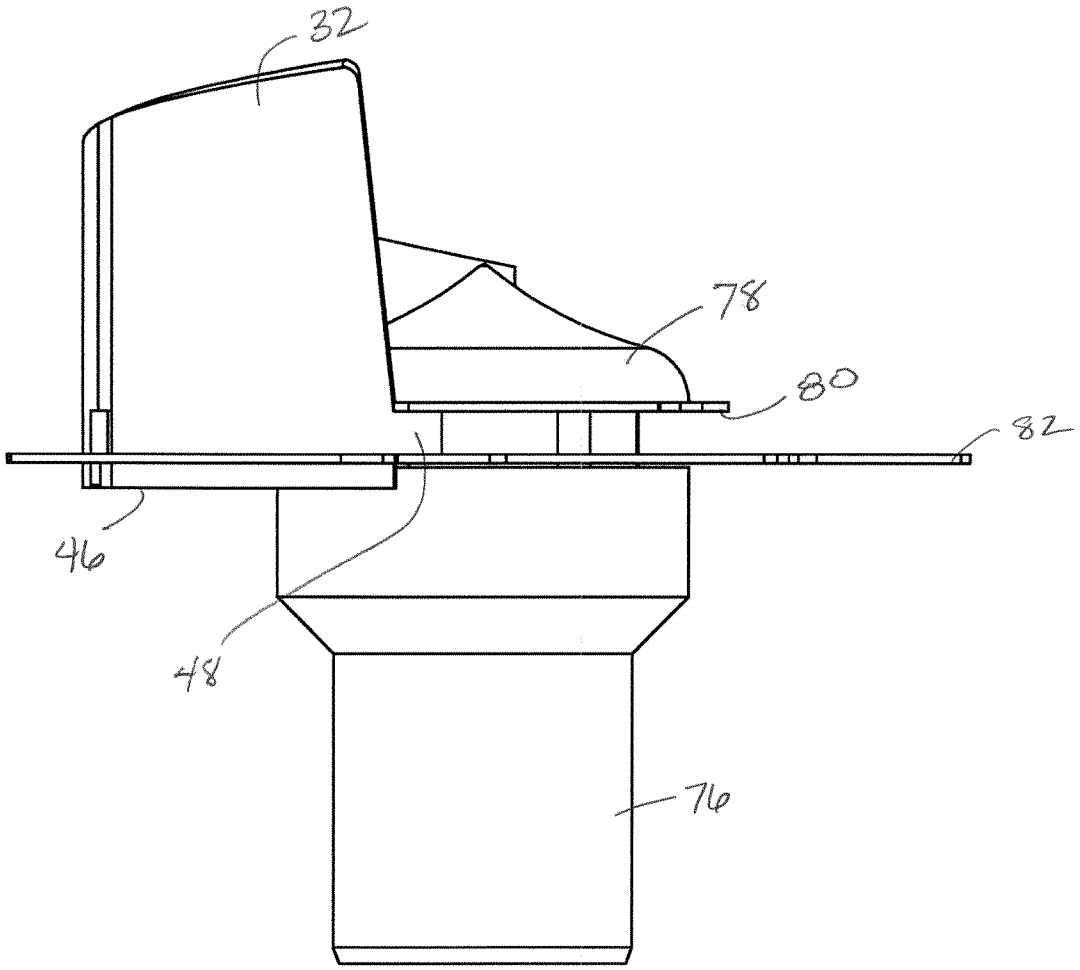
FIG. 10 is a plan view of a partially assembled impeller according to one aspect of the present disclosure with a single removable vane secured relative to a back plate.

FIG. 10 further illustrates the relative position of optional additional back plates 80 and 82 relative to a single vane 32 and hub 74. The back plate 30 is omitted for clarity. The tab 48 is captured and secured by the additional back plates 80 and 82, together with the first and second portions 76 and 78 of the hub 74.

Figure 11:
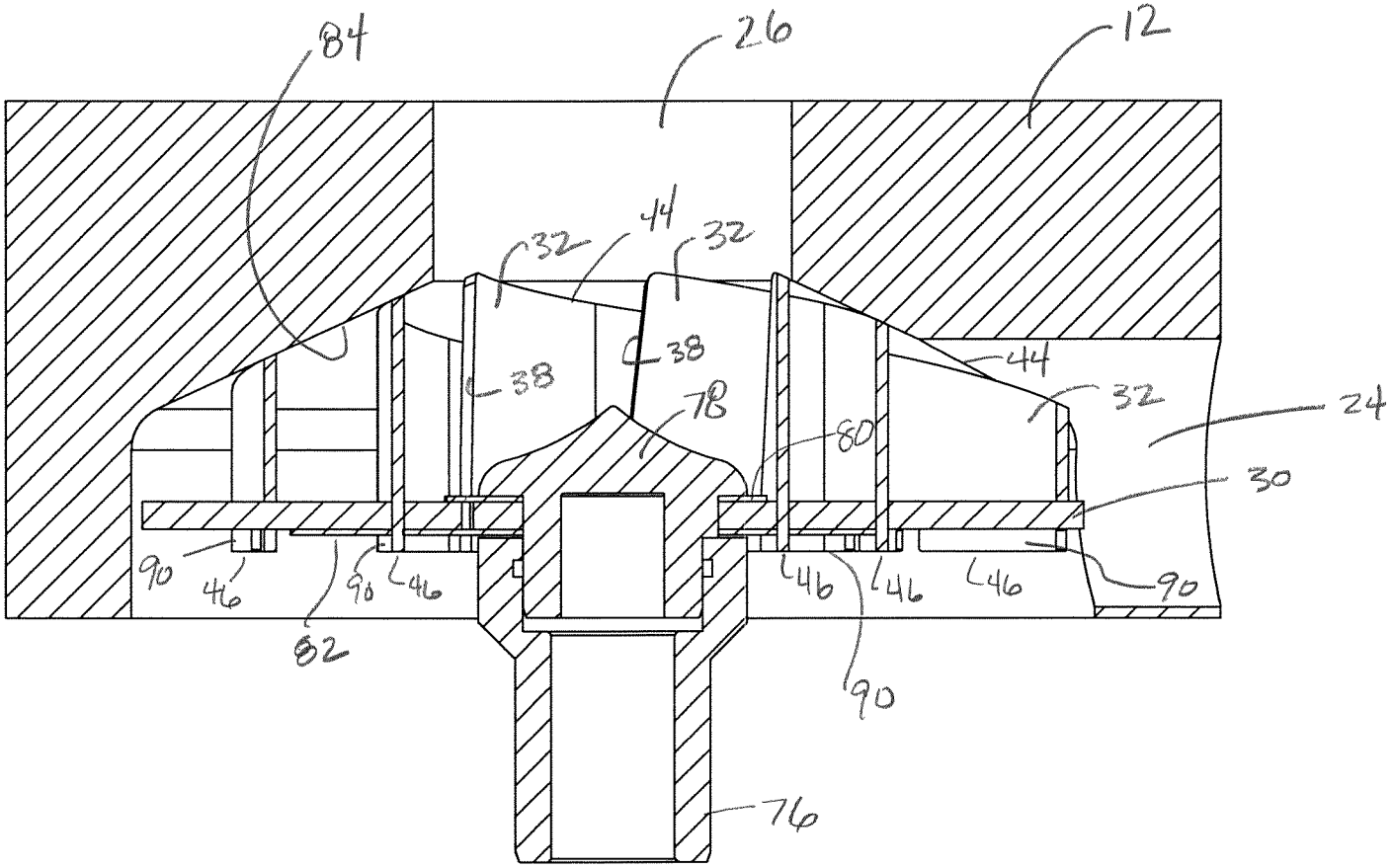
FIG. 11 is a cross-sectional view of an impeller assembled within a pump casing according to aspects of the present disclosure.
Figures 12A, 12B, 12C:
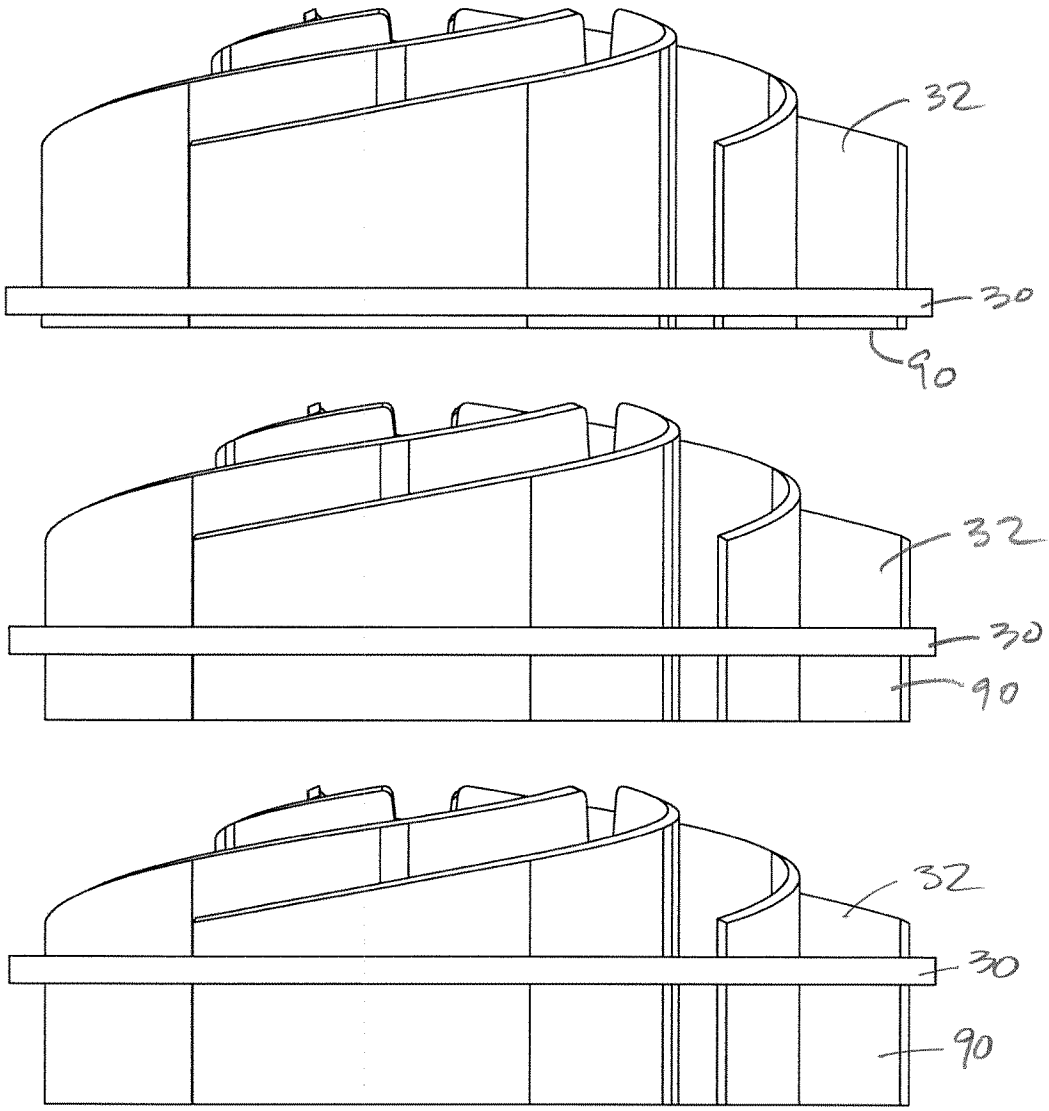
FIG. 12A is a plan view of an impeller according to aspects of the present disclosure.
FIG. 12B is a plan view of an impeller according to aspects of the present disclosure.
FIG. 12C is a plan view of an impeller according to aspects of the present disclosure.

FIG. 11 is a cross-sectional view of a fully assembled impeller 22 positioned in the chamber 24 of a pump casing 12 according to one aspect of the present disclosure. As illustrated, a portion of each vane 32 extends axially outwardly from the back plate 30 such that the axial outer edge 44 of the vane is positioned adjacent the inner surface 84 of the chamber 24. A second portion of each vane 32 extends axially inward from the back plate 30 and forms the expeller portion 90 of the impeller 10. It should be appreciated that the vanes 32 may be configured and built to orient at different positions relative to the back plate 30 according to different embodiments of the present invention. More specifically, for a given internal chamber 24, the vanes 32 may be designed to provide different impeller vane depths and expeller vane depths using the same back plate to vary the performance specifications of a specific pump casing. FIG. 12A illustrates an embodiment in which the majority of the axial length of the vanes 32 is positioned on the axial outer side of the back plate 30 and a relatively small portion of the vanes 32, forming the expeller, are positioned on the axial inward side of the back plate 30. FIG. 12B shows more of the vanes 32 extending through the back plate 30 to enhance the expeller portion 90. FIG. 12C shows even more of the axial length of the vanes 32 extending through the back plate 30 and forming the expeller portion 90.

FIGS. 13A-13F show variety of vane curvatures. FIGS. 13A and 13B show a vane having a significantly curved profile. FIGS. 13C and 13D show a vane 32 having a less curved profile. FIGS. 13E and 13F show a straight vane. It should be appreciated by those of skill in the art that the embodiments of the present invention allow for vanes of an infinite range of curvatures from flat to significantly curved, and of constant radial curvature or complex curvatures as may be required to meet pump operating conditions. It is contemplated by the embodiments of the present application that for any given internal chamber of a specific casing, different back plates 30 may be made to operate in association with the existing shaft to provide a wide variety of different numbers of vanes and a different number of vane configurations, including but not limited to vane impeller and expeller depths, vane curvatures, vane profile, and angular orientation relative to the back plate.

According to aspects of the present disclosure, the configuration of the vanes 32 may also vary to achieve desired performance characteristics. FIGS. 14A, 14B and 14C illustrate the principal that the replaceable impeller vanes may vary in the axial direction. FIG. 14A illustrates a vane 32 with an axial outer edge 44 with a large degree of slope in the radial direction. FIG. 14B shows an impeller vane 32 with an axial outer edge 44 with a moderate degree of slope in the radial direction. FIG. 14C shows an impeller vane 32 with an axial outer edge 44 that has a flat or no slope. Although the vanes 32 depicted in FIGS. 14A-14C are straight, they may also have a two dimensional curve in the radial direction and/or have a more complex three dimensional curvature. More specifically, the vanes 32 are curved in the radial direction, from inner radial edge 38 to outer radial edge 40, and in the axial direction as illustrated by the sloped vane shape along the outer axial edge 44. It should be further appreciated that all of the edges of a vane, the axial outer edge 44, the axial inner edge 46, the radial inner edge 38 and radial outer edge 40 may vary in slope or profile, wherein the shape may include cutouts or other non-uniformities that alter fluid flow.

Figure 14D:
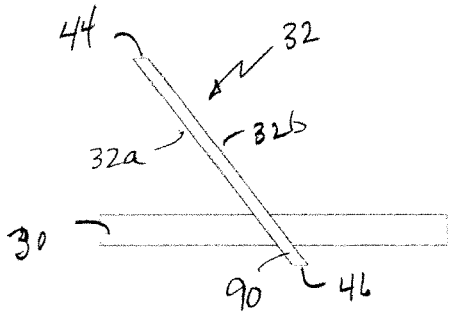
FIG. 14D is a partial elevation view of an impeller back plate and vane according to aspects of the present disclosure.
Figure 14E:
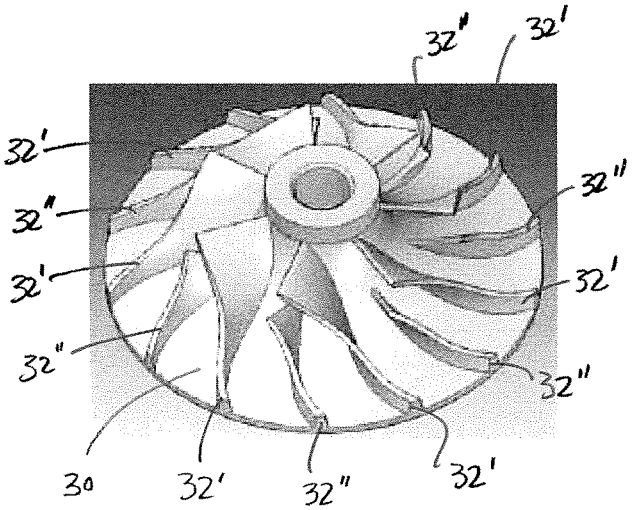
FIG. 14E is a perspective view of an impeller made according to aspects of the present disclosure.
Figure 14F:
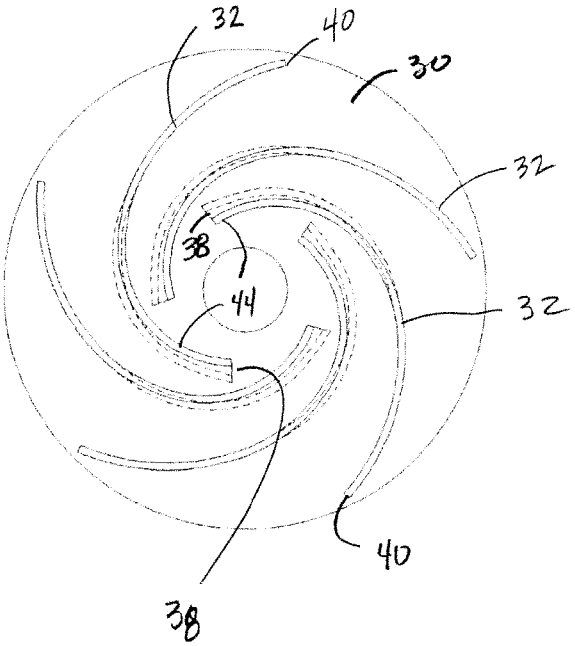
FIG. 14F is a top plan view of an impeller made according to aspects of the present disclosure.

Examples of vanes 32 with a complex configuration or curvature are illustrated in FIGS. 14D-14G. FIG. 14D illustrates an aspect of the present disclosure where the slot 36 is formed at an angle relative to the back plate 30 such that one surface 32*a* is positioned at an acute angle relative to the back plate and a second surface 32*b* is positioned at an obtuse angle relative to the back plate. FIG. 14E illustrates an impeller with a three dimensional complex shape, where the vanes 32 are curved radially and axially. For example, the axial outer edges 44 are laid over or "dog eared." Also, two differently configured sets of vanes 32' and 32" alternate on the back plate. The radial length of one set of vanes 32' is staggered relative to the length of the second set of vanes 32". FIG. 14F illustrates a top plan view of an impeller where the vanes 32 are identical, but each vane has a complex configuration. Complex in this context means the vane has curvature in three dimensions, not just two dimensions as illustrated in FIGS. 13A and 13C. Complex vanes provide further performance alternatives.

It should also be appreciated that the shape or configuration of the replaceable vanes 32 may vary from the profiles as shown in the accompanying Figures. The reasons to alter vane profiles are for performance and efficiency of a particular pump, and to accommodate different pumpages. Thus, a single back plate may be utilized with different sized and shaped vanes in different chambers of different casings or one of a variety of back plates may be selected and combined with a variety of vane styles to meet end use applications.

Figure 14G:
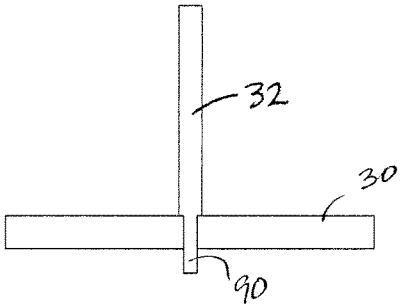
FIG. 14G is a partial elevation view of an impeller back plate and vane according to aspects of the present disclosure.
Figure 15:
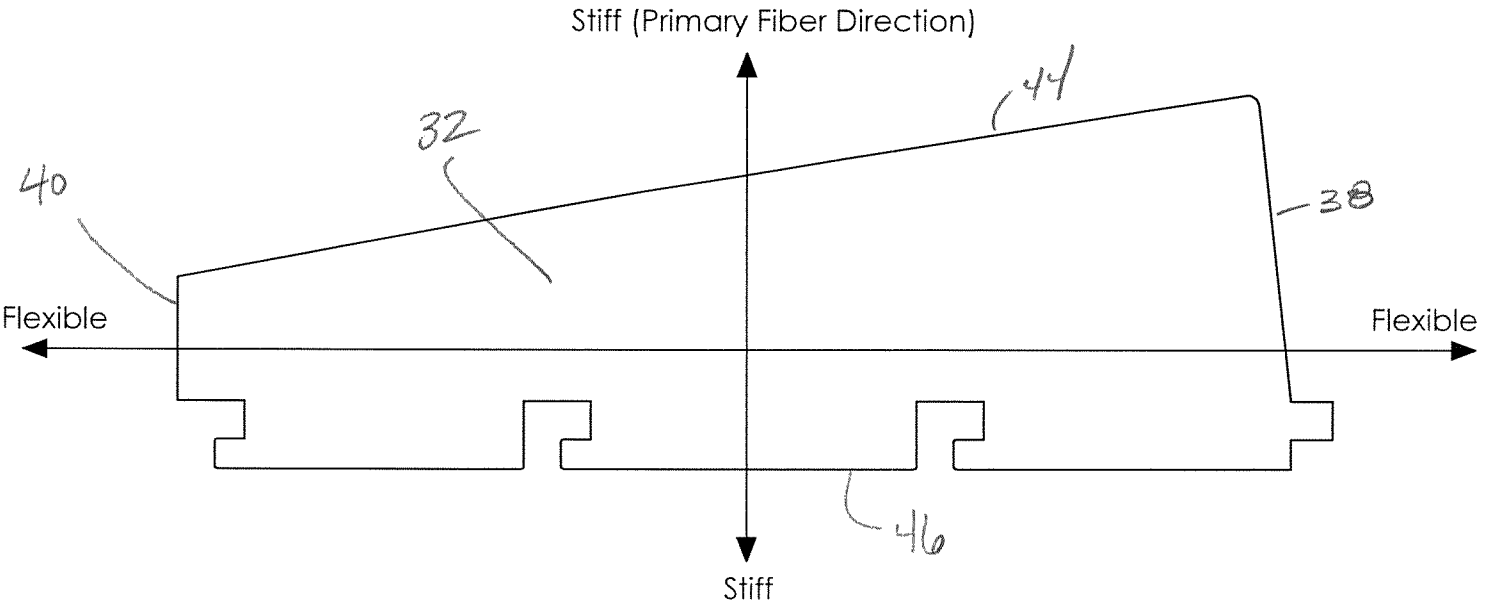
FIG. 15 is a plan view of a composite vane made according to aspects of the present disclosure.

In another aspect of the invention, the replaceable vanes may be made from metal, composite materials or plastic. Vanes may also be made thicker or thinner. A vane 32 having increased thickness is shown in FIG. 14G. Vanes may also be made with varying surface smoothness or roughness, and may include grooves or other surface effects to assist in moving the pumpage. If made from composite materials, according to one aspect of the present disclosure, the primary fibers of the composite material may be aligned in the axial direction. With the primary fibers so aligned, the vane will have desirable stiffness in the axial direction, yet will have flexibility in the radial direction along the length of the vane. FIG. 15 illustrates this concept. In this manner, the vanes will be sufficiently pliable to adapt to more than one curved configuration such that a single vane may be utilized with multiple back plates having differently configured slots. It should also be appreciated that the composite fibers may be differently oriented to achieve different results in vane characteristics.

Figure 16A:
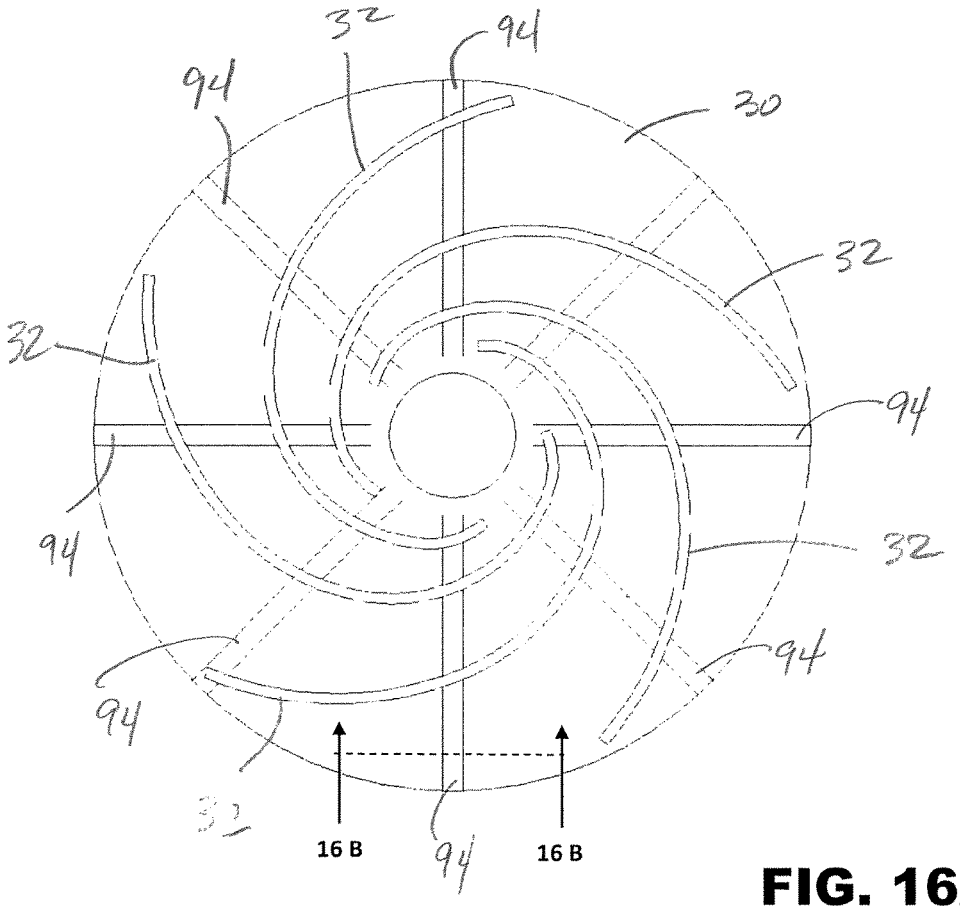
FIG. 16A is a top plan view of an impeller made according to aspects of the present disclosure.
Figure 16B:
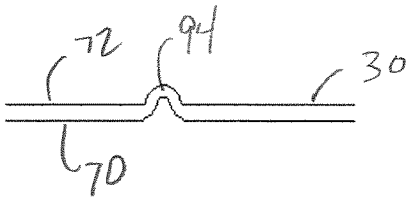
FIG. 16B is a partial elevation view of the impeller of FIG. 16A, taken along ling 16B-16B.

FIGS. 16A and 16B illustrate a further aspect of the present disclosure. Here, the back plate 30 may be made from thinner material, or from plastic or composites as the end application allows. Ribs 94 are formed in the back plate to add rigidity. The ribs 94 may be oriented radially straight as illustrated in FIG. 16A, or they may follow the curvature of the vanes 32 or some other curvature. The ribs 94 may also be formed on one or both surfaces 70 and 72 of the back plate.

Figure 17A:
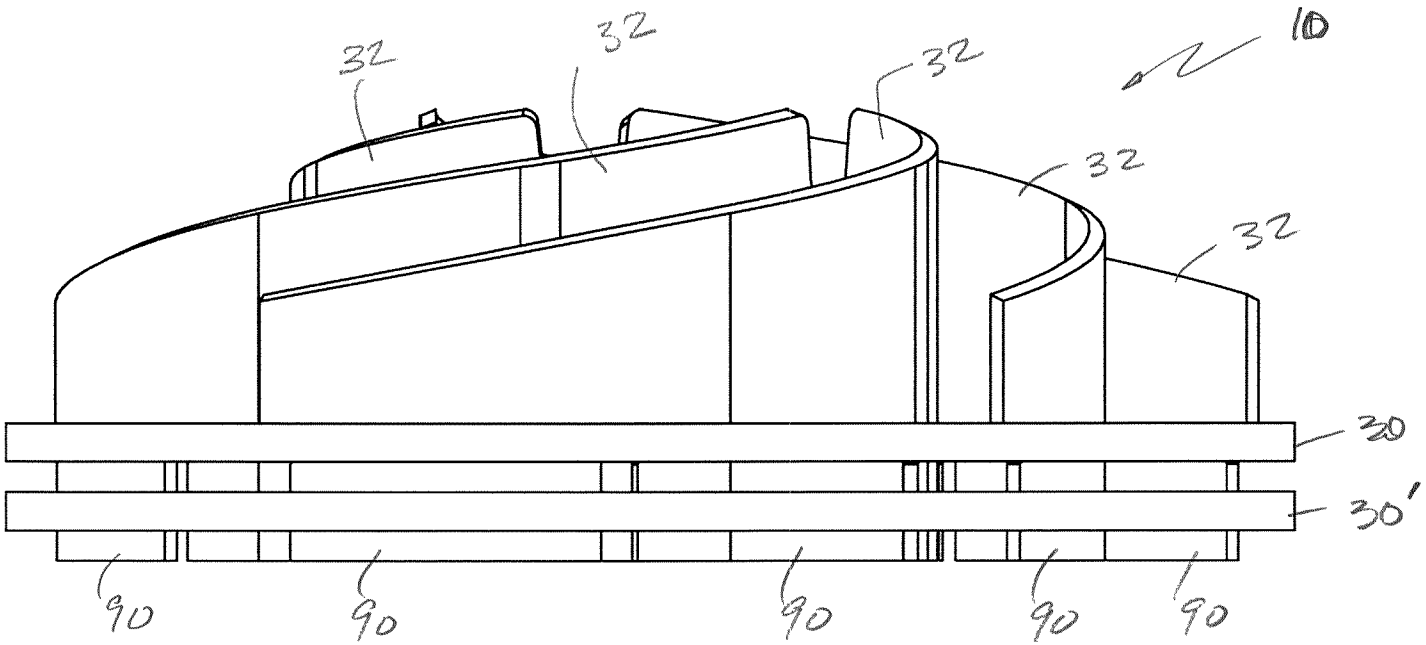
FIG. 17A is a plan view of an impeller made according to aspects of the present disclosure.
Figure 17B:
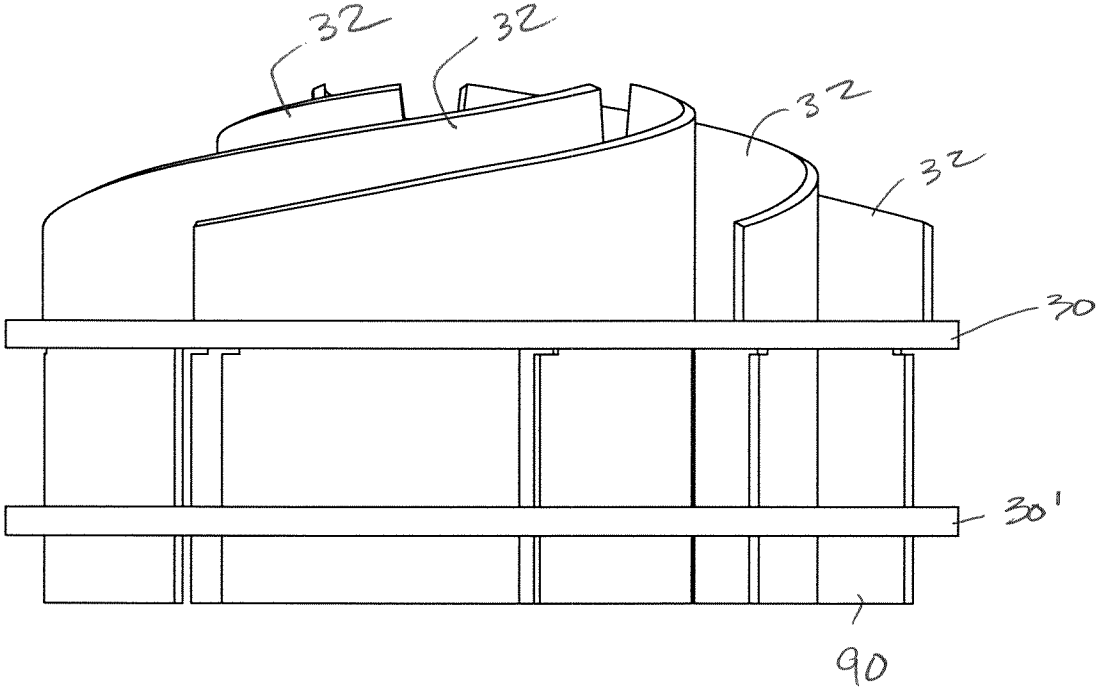
FIG. 17B is a plan view of an impeller made according to aspects of the present disclosure.

All of the impellers described thus far are open impeller designs. FIGS. 17A and 17B show further aspects of the present disclosure. In FIG. 17A, the configuration of impeller 10 utilizes dual back plates 30 and 30'. Dual back plates provide added support and rigidity to the impeller by providing support to the vanes 32 at multiple locations along the axial length of the vanes. By providing increased support, the individual back plates 30 and 30' may be constructed using less material, and the individual vanes 32 may also be constructed using less material or have a thinner profile, made from less expensive material or less rigid metals or carbon fibers, thereby saving cost while maintaining performance. FIG. 17B shows an alternative design with the back plates 30 and 30' spaced further apart. Also, the expeller vanes 90 are deeper compared to FIG. 17A. The configuration illustrated in FIG. 17B, and to a lesser extent in FIG. 17A, is a hybrid design. In other words, these configurations combine performance characteristics of both open and close impeller designs.

Figure 18A:
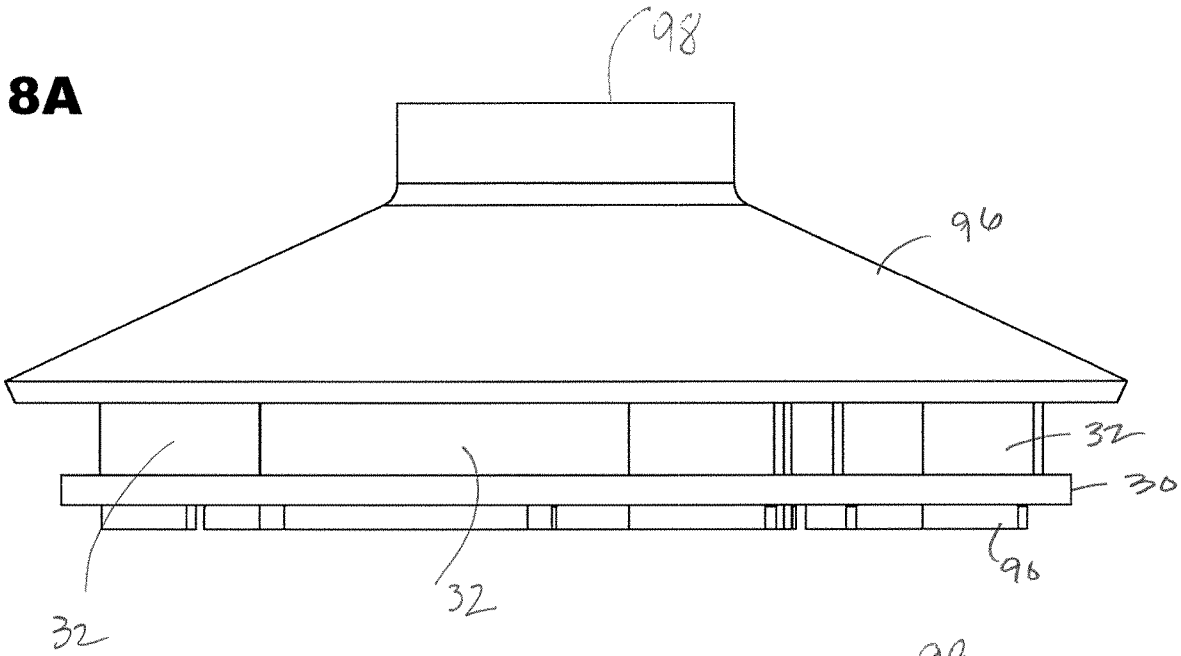
FIG. 18A is a plan view of an impeller made according to aspects of the present disclosure.
Figure 18B:
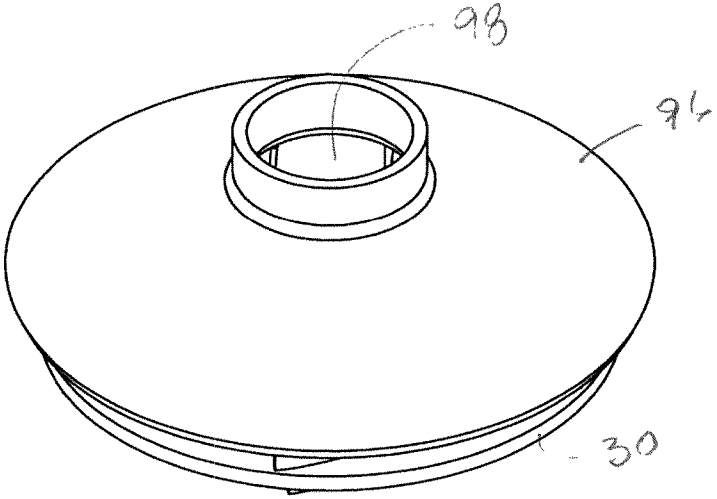
FIG. 18B is a perspective view of the impeller of FIG. 18A.

Impellers according to the present disclosure can also be made with a closed impeller design such as shown in FIGS. 18A-18B. Here, an end plate 96 is configured to enclose the axial outer edges 44 of the vanes 32 to provide a closed impeller configuration. The end plate 96 includes a central aperture 98 to allow intake of fluids. The end plate 96 may be configured so as to connect to the end of shaft 16 utilizing an internal hub, or alternatively may be configured to attach to the axial outer edge 44 of the vanes 32 themselves, such as by the locking arrangements shown in FIGS. 6A-6C.

Figure 19A:
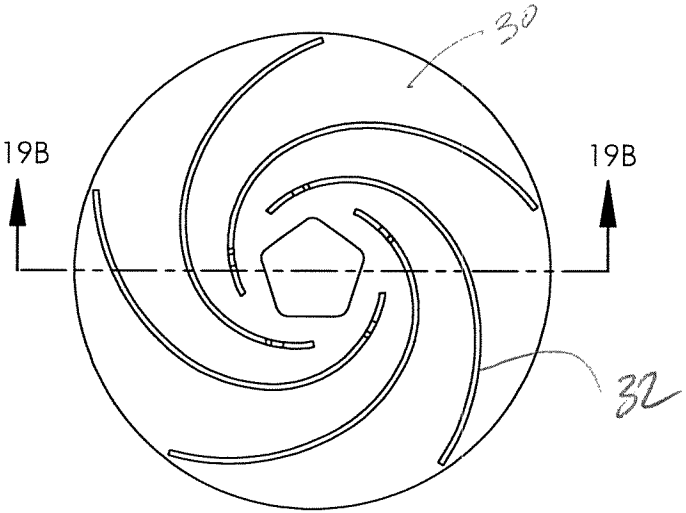
FIG. 19A is a top plan view of an impeller according to aspects of the present disclosure.
Figure 19B:
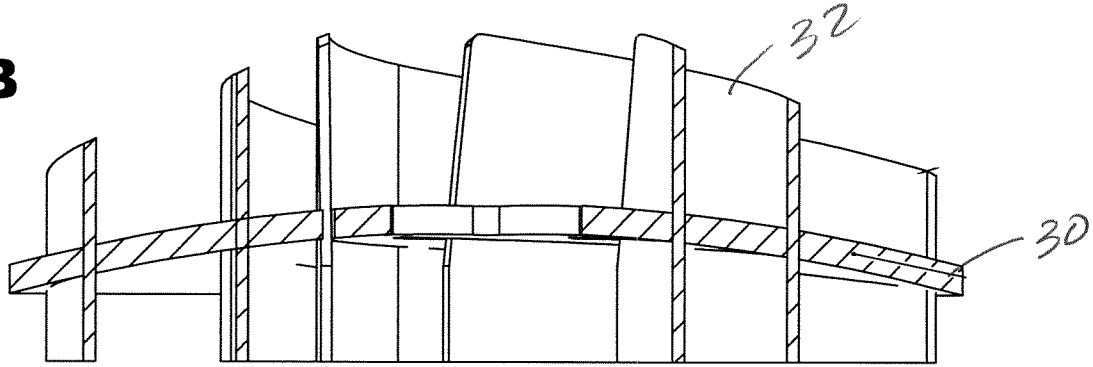
FIG. 19B is a cross sectional view of the impeller of FIG. 19A taken along line 19B-19B.

FIGS. 19A and 19B illustrate a further aspect of the present disclosure. As shown, the back plate 30 has a curved or concave profile. The curved profile provides additional structural rigidity to the back plate, allowing it to be made from less rigid or thinner materials, resulting in potential cost savings. Also, the perimeter edge 42 of the back plate 30 need not be circular. For example, a scalloped perimeter edge where cutouts are formed along the perimeter edge may reduce axial thrust by reducing surface area of the back plate.

Figure 20:
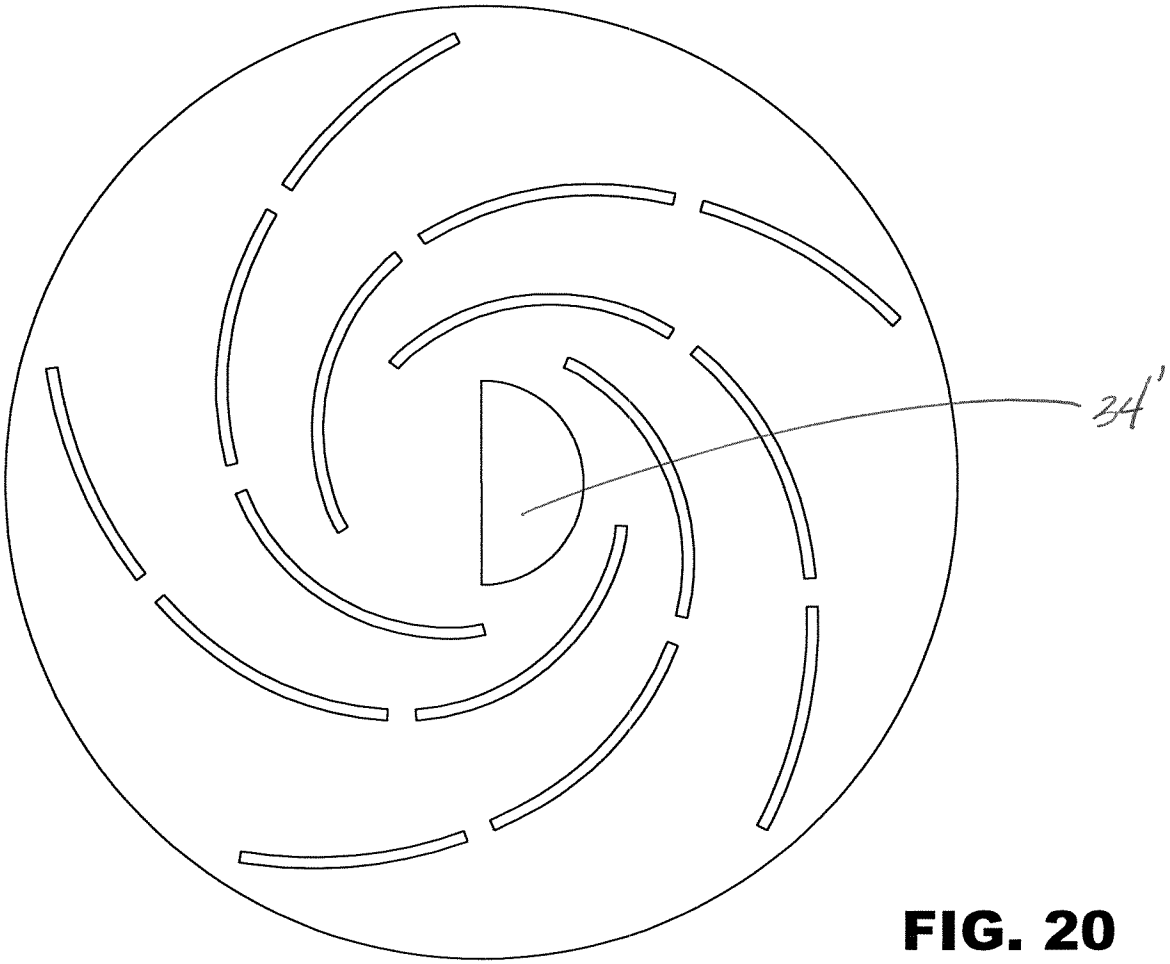
FIG. 20 is a top plan view of an impeller back plate according to aspects of the present disclosure.

FIG. 20 shows a further aspect of the present disclosure. As illustrated, the aperture 34' is a "D"-shape rather than the pentagon shape shown in other embodiments. It should be appreciated by those of skill in the art that the center aperture can have a variety of configurations sufficient for securement to the shaft 16.

Figure 21A:
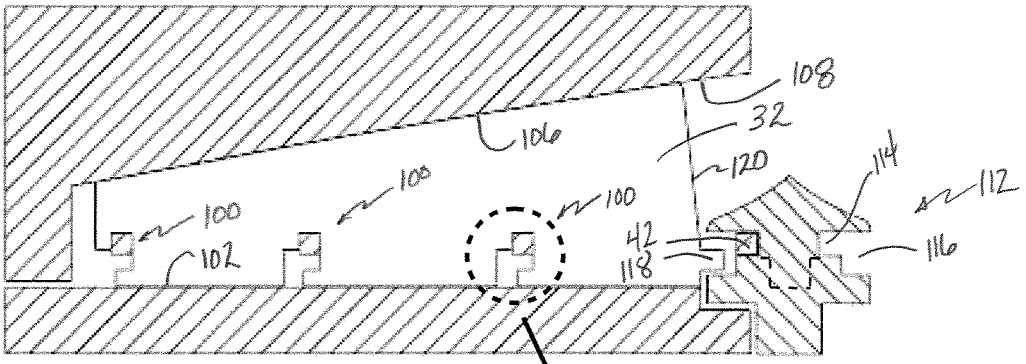
FIG. 21A is a cross sectional view of a portion of an impeller installed within a pump casing according to aspects of the present disclosure.
Figure 21B:
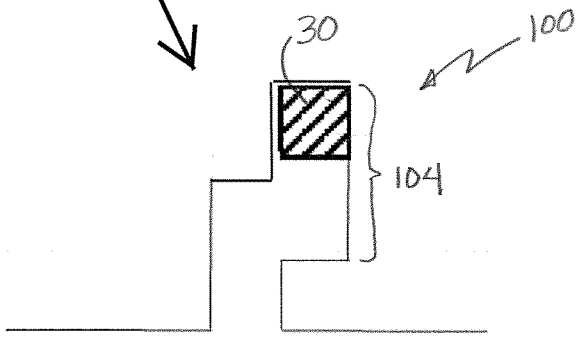
FIG. 21B is an enlarged partial view of an exemplary cutout as illustrated in FIG. 21A.
Figure 22A:
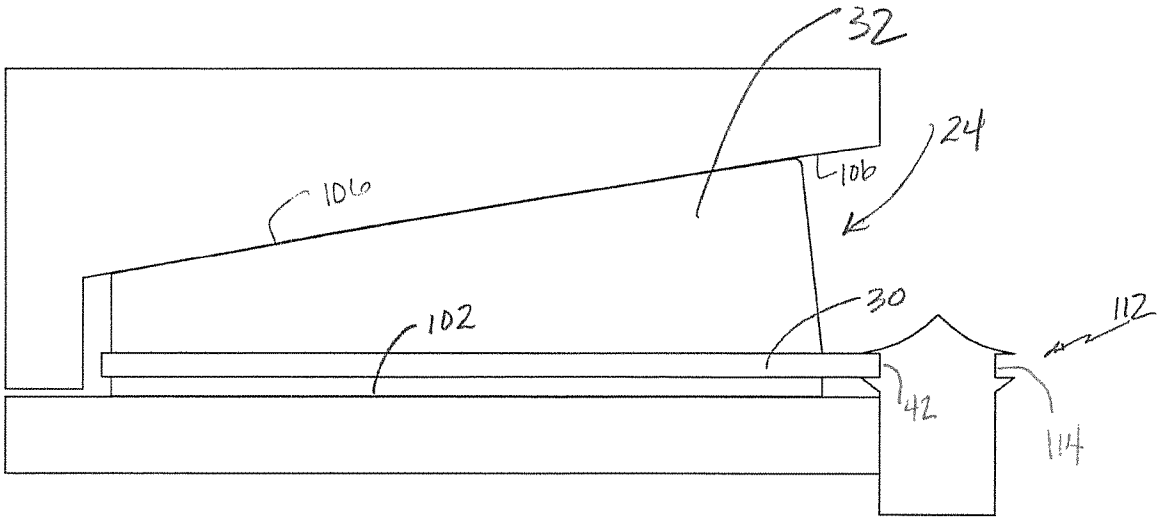
FIG. 22A is a cross sectional view of a portion of an impeller in a first state according to aspects of the present disclosure.
Figure 22B:
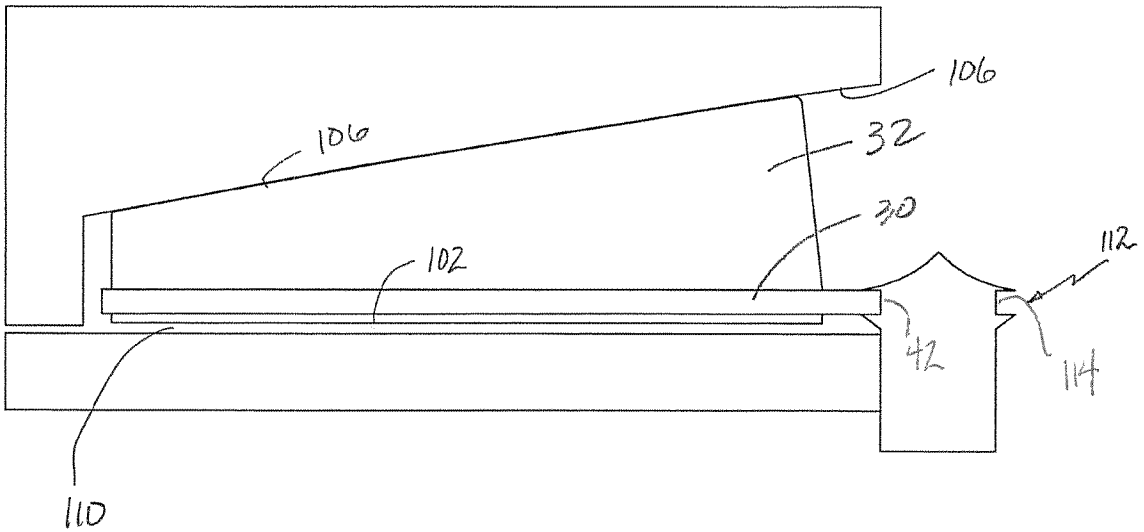
FIG. 22B is a cross sectional view of the partial impeller of FIG. 22A in a second state according to aspects of the present disclosure.

According to another aspect of the present disclosure, the vanes 32 may be designed to float or move relative to a back plate 30. FIG. 21A is a cross-sectional view of such an embodiment. A vane 32 is positioned within the chamber 24. Cutouts 100 are formed along the axial inner edge 102. Here, as more clearly shown in FIG. 21B, the cutouts 100 are generally "S" or "Z" shaped to engage and secure the back plate 30. The cutouts 100 include an axially oriented channel 104 having an axial length that allows the vane 32 to move relative to the back plate 30 in the axial direction. FIGS. 22A and 22B illustrate the concept that over time the axial outer edge 106 of the vane 32 wears against the inner surface 108 of the chamber 24. Over time the vane 32 will decrease in axial length due to the wear, but the vane will automatically reposition itself relative to the back plate 30 such that the outer axial edge 106 remains in contact with the interior surface of the chamber while the axial inner edge 102 increasingly separates from the inner surface of the chamber 24 to form a gap 110. As illustrated in FIGS. 21A, 22A and 22B, the hub 112 is configured with an inner notch 114 to fixedly secure the perimeter edge 42 of the back plate and an axially extended outer notch 116 to allow the tab 118 at the inner radial edge 120 of the vane 32 to float relative to the hub 112. The hub 112 may comprise multiple component pieces interconnected during assembly in order to secure the vane and back plate. In this manner, the vane is allowed to float and maintain contact with the inner surface of the chamber to provide a best case for efficiency and permit longer life for the impeller vanes 32.

In view of the foregoing, it will be appreciated that one may dismantle an existing pump and change the vanes to thereby transform an existing pump into something better. However, the ability to design and produce quickly a more suitable or preferred impeller for a given application is an equally if not more important benefit. The more suitable or preferred impeller design being the design that achieves the desired flow and head at the lowest power draw or highest efficiency and at the lowest part cost. For a given pump application, such an impeller may be designed and manufactured more quickly and effectively, giving the end user or customer significantly improved if not optimal performance and service.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

While various embodiments of the safety system present invention have been described in detail, it is apparent that modifications and alterations of those embodiments will occur to those skilled in the art. However, it is to be expressly understood that such modifications and alterations are within the scope and spirit of the present invention. In addition, it should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein. Other modifications or uses for the present invention will also occur to those of skill in the art after reading the present disclosure. Such modifications or uses are deemed to be within the scope of the present invention.

What is claimed is:

1. A pump impeller, comprising:

a. a first plate having a first surface, a second surface and a perimeter edge disposed between the first and second surfaces;

b. an aperture at the center of the plate extending through the plate and configured to receive a shaft for rotating the impeller;

c. a plurality of slots extending through the plate between the first and second surfaces, the slots extending from a first position proximate the aperture to a second position proximate the perimeter edge;

d. a plurality of removable vanes, wherein each vane extends into at least a single slot when secured to the first plate, and wherein each vane is removable from the at least a single slot;

e. a second plate having a first surface and a second surface and a perimeter edge disposed between the first and second surfaces;

f. a second aperture at the center of the second plate extending through the second plate and configured to receive the shaft; and g. a plurality of slots disposed in the second plate, and wherein the second plate is disposed at a distance from the first plate and each vane engages a slot formed in the second plate such that the vanes extend between the first and second plates.

2. The impeller of claim 1, wherein at least one vane is removably secured in a plurality of slots.

3. The impeller of claim 2, wherein the vanes extend through the first and second plates and in both axial directions away from the first surface of the first plate and away from the second surface of the second plate.

4. The impeller of claim 1, wherein each slot of the plurality of slots is curved.

5. The impeller of claim 1, wherein each vane is oriented perpendicular to at least one of the first and second plates.

6. The impeller of claim 1, wherein each vane has a length extending between the first position and the second position, and wherein at least one vane is curved along its length.

7. The impeller of claim 1, wherein each vane comprises a first surface and a second surface, and wherein the first surface is oriented at an acute angle relative to at least the first plate and the second surface is oriented at an obtuse angle relative to at least the first plate.

8. The impeller of claim 1, wherein a radial direction is defined as extending outwardly away from the shaft, and wherein at least some of the plurality of vanes are curved in the radial direction.

9. The impeller of claim 1, wherein at least some of the plurality of removable vanes comprise a vane with a curvature in three dimensions.

10. The impeller of claim 1, wherein each vane comprises a composite fiber material, and the fibers are substantially oriented in the axial direction.

11. The impeller of claim 1, wherein at least one of the first and second plates is substantially flat.

12. The impeller of claim 1, further comprising ribs disposed on at least one surface of at least one of the first and second plates.

13. The impeller of claim 1, wherein the first surface of at least one of the first and second plates is curved.

14. The impeller of claim 13, wherein at least one of the first and second plates has a convex shape.

15. The impeller of claim 1, wherein each vane comprises a body having a first edge with a plurality of cutouts positioned along the edge and configured to engage the first or second plate.

16. The impeller of claim 15, wherein the body of each vane comprises a first end and a second end, and further comprises a tab extending from the first end, the tab configured to engage a hub configured to secure the impeller to the shaft.

17. The impeller of claim 16, wherein the hub comprises a first member and a second member, and wherein the first member of the hub and the second member of the hub are secured to each other.

18. The impeller of claim 15, wherein each cutout comprises a plurality of surfaces and at least three surfaces of each cutout engage a surface of the plate.

19. The impeller of claim 1, wherein the plurality of slots are elongate.

20. An impeller and expeller, comprising:

a. a single plate having a first surface, a second surface and a perimeter edge disposed between the first and second surfaces;

b. an aperture at the center of the plate extending through the plate and configured to receive a shaft for rotating the impeller;

c. a plurality of slots extending through the plate between the first and second surfaces; and d. a plurality of removable vanes, wherein at least one vane extends through at least two of the plurality of slots when secured to the first plate and extends axially outwardly from the first surface to form the impeller and from the second surface to form the expeller.

21. The impeller and expeller of claim 20, wherein each vane is removably secured in a respective subset of the plurality of slots.

22. The impeller and expeller of claim 20, wherein at least one vane is curved along its length.

23. The impeller and expeller of claim 20, wherein the first surface of the plate is curved.

24. The impeller and expeller of claim 23, wherein the second surface of the plate is curved.

25. The impeller and expeller of claim 20, wherein each vane comprises a composite fiber material, and the fibers are substantially oriented in the axial direction.

26. The impeller and expeller of claim 20, wherein a portion of each vane positioned within the at least two of the plurality of slots comprises a majority of the radial length of each vane.

27. The impeller and expeller of claim 20, wherein at least some of the plurality of removable vanes comprise a vane with a curvature in three dimensions.

28. The impeller and expeller of claim 20, wherein each vane comprises a first surface and a second surface, and wherein the first surface is oriented at an acute angle relative to the plate and the second surface is oriented at an obtuse angle relative to the plate.

29. A pump impeller, comprising:

a. a plate having a first surface, a second surface and a perimeter edge disposed between the first and second surfaces;

b. an aperture at the center of the plate extending through the plate and configured to receive a shaft for rotating the impeller, wherein the shaft defines an axial direction;

c. a plurality of slots extending through the plate between the first and second surfaces, the slots extending from a first position proximate the aperture to a second position proximate the perimeter edge;

d. a plurality of vanes, wherein the vanes extend in an axial direction away from the first surface, wherein each vanes comprises an axially inner edge and at least one cutout is disposed proximate the axially inner edge, wherein each vane extends through at least a single slot when secured to the plate and extends axially outwardly from the first surface to form an impeller and wherein the at least one cutout comprises an axially extending channel configured to allow repositioning of each vane relative to the plate in the axial direction while the plate is rotating.

30. The pump impeller of claim 29, wherein each vane comprises a composite fiber material, and the fibers are substantially oriented in the axial direction.

31. The pump impeller of claim 29, wherein each cutout comprises a plurality of surfaces and at least three surfaces of each cutout engage a surface of the plate.

32. The pump impeller of claim 29, wherein at least one vane is curved along its length.

33. The pump impeller of claim 29, wherein at least some of the plurality of removable vanes comprise a vane with a curvature in three dimensions.

34. A centrifugal pump, comprising:

a. a casing defining an interior chamber;

b. a shaft having a first end and a second end and defining an axial direction along its length, the second end extending into the chamber;

c. an impeller comprising:

i. a single plate having a first surface, a second surface and a perimeter edge disposed between the first and second surfaces, an aperture at the center of the plate extending through the plate and configured to receive the shaft;

ii. a plurality of slots extending through the plate between the first and second surfaces; and iii. a plurality of removable vanes, wherein each vane comprises a body having a radial inner end and a radial outer end spaced from the radial inner end and defining the radial length of the body, wherein a portion of each vane is positioned within at least one slot and each vane is removably secured within the at least one slot, wherein the portion of each vane positioned within the at least one slot comprises a majority of the radial length of each vane, wherein each vane extends axially away from the first surface of the plate and axially away from the second surface of the plate to form an expeller.

35. The centrifugal pump of claim 34, wherein the first surface of the plate is curved.

36. The centrifugal pump of claim 34, wherein each slot of the plurality of slots is curved.

37. The centrifugal pump of claim 34, wherein each vane comprises a first end and a second end, and further comprises a tab extending from the first end, the tab configured to engage a hub configured used to secure the impeller to the shaft.

38. The centrifugal pump of claim 34, wherein each vane comprises a first surface and a second surface, and wherein the first surface is oriented at an acute angle relative to the plate and the second surface is oriented at an obtuse angle relative to the plate.

* * * * *